US007542824B2

(12) United States Patent
Miki et al.

(10) Patent No.: US 7,542,824 B2
(45) Date of Patent: Jun. 2, 2009

(54) AIR CONDITIONING CONTROL DEVICE

(75) Inventors: Toshiyuki Miki, Kusatsu (JP); Satoshi Hashimoto, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 12/279,941

(22) PCT Filed: Dec. 19, 2007

(86) PCT No.: PCT/JP2007/074378

§ 371 (c)(1),
(2), (4) Date: Aug. 19, 2008

(87) PCT Pub. No.: WO2008/084635

PCT Pub. Date: Jul. 17, 2008

(65) Prior Publication Data

US 2008/0306632 A1 Dec. 11, 2008

(30) Foreign Application Priority Data

Dec. 22, 2006 (JP) ..... 2006-346073

(51) Int. Cl.

| | |
|---|---|
| ***G05D 3/12*** | (2006.01) |
| ***G05D 5/00*** | (2006.01) |
| ***G05D 9/00*** | (2006.01) |
| ***G05D 11/00*** | (2006.01) |
| ***G05D 17/00*** | (2006.01) |
| ***G05D 23/00*** | (2006.01) |
| ***G01M 1/38*** | (2006.01) |
| ***G05B 13/00*** | (2006.01) |
| ***G05B 15/00*** | (2006.01) |
| ***G05B 11/01*** | (2006.01) |
| ***G01R 21/06*** | (2006.01) |
| ***F25B 49/00*** | (2006.01) |
| *G05D 23/32* | (2006.01) |
| *F25B 29/00* | (2006.01) |

(52) U.S. Cl. ..... 700/291; 700/17; 700/19; 700/22; 700/276; 700/295; 702/62; 236/94; 62/126; 62/157; 62/159

(58) Field of Classification Search ..... 700/17, 700/19, 22, 83, 276–278, 286, 291, 295; 702/52, 60–62, 182, 183; 236/1 R, 1 B, 94; 62/125, 126, 132, 157, 159
See application file for complete search history.

(56) References Cited

U.S. PATENT DOCUMENTS 6,980,079 B1 * 12/2005 Shintani et al. ..... 340/3.1

(Continued)

FOREIGN PATENT DOCUMENTS

| | | | |
|---|---|---|---|
| JP | 09042737 A | * | 2/1997 |
| JP | 2000-018691 A | | 1/2000 |
| JP | 2003132787 A | * | 5/2003 |
| JP | 2004-226062 A | | 8/2004 |
| JP | 2004301505 A | * | 10/2004 |

(Continued)

*Primary Examiner*—Crystal J Barnes-Bullock
(74) *Attorney, Agent, or Firm*—Global IP Counselors

(57) ABSTRACT

An air conditioning control device is configured to obtain and control data on an air conditioner, which includes a plurality of indoor units. The air conditioning control device includes a data retrieval component, a data collection component, an analysis component, and an analyzed results display component. The data retrieval component retrieves air conditioner operating data including power consumption data for each indoor unit. The data collection component collects operating data at certain periods of time. The analysis component analyzes operating data for each indoor unit. The analyzed results display component visualizes and displays the analyzed data that has been analyzed by the analysis component.

13 Claims, 20 Drawing Sheets

U.S. PATENT DOCUMENTS

| | | | | |
|---|---|---|---|---|
| 6,983,210 | B2 * | 1/2006 | Matsubayashi et al. | 702/60 |
| 7,062,927 | B2 * | 6/2006 | Kwon et al. | 62/126 |
| 7,216,021 | B2 * | 5/2007 | Matsubara et al. | 700/295 |
| 7,287,393 | B2 * | 10/2007 | Kwon et al. | 62/157 |
| 7,489,988 | B2 * | 2/2009 | Matsui et al. | 700/287 |
| 2002/0030478 | A1 * | 3/2002 | Nagamitsu et al. | 324/110 |
| 2008/0195237 | A1 * | 8/2008 | Mukaigawa et al. | 700/90 |

FOREIGN PATENT DOCUMENTS

| | | | | |
|---|---|---|---|---|
| JP | 2006078045 | A | * | 3/2006 |
| JP | 2006-162213 | A | | 6/2006 |
| JP | 2006162213 | A | * | 6/2006 |
| JP | 292279 | A | | 10/2006 |

* cited by examiner

ONE-STORY PLAN

NORTH SIDE

SOUTH SIDE

TWO- AND THREE-STORY PLAN

WASTEFUL OPERATION
ELIMINATION
COUNTERMEASURES

The power consumption of indoor unit 42c has increased because the temperature setting is low. It is recommended that the remote control temperature setting be increased.

SC21

91 MENU

FIG. 7

POWER DEMAND ON DAY WITH GREATEST POWER DEMAND PEAK

PEAK POWER
COUNTERMEASURES

Because the power demand in indoor unit 42c is high, it is recommended that the power demand control level in room A be increased to level 4.

Because the power demand in indoor unit 52e is high, it is recommended that the power demand control level in room D be increased to level 5.

Because the power demand in indoor unit 52f is high, it is recommended that the power demand control level in room D be increased to level 5.

SC22

92 MENU

FIG. 10

COMFORT MAINTENANCE COUNTERMEASURES

The change in temperature during the morning and evening is considered significant in room A. It is recommended that the level of outside air introduced into room A be reduced.

The outdoor air load on room C has increased. It is recommended that the level of outside air introduced into room C be limited or that solar radiation be controlled.

The air conditioning is working too much at startup in room A. It is recommended that the air level at startup be controlled.

SC24

94 MENU

FIG. 14

OUTDOOR AIR INTRODUCTION COUNTERMEASURES

The internal load on room A, room, C, and room D may have increased. It is recommended that the outdoor intake level for the rooms be increased.

SC25

95 MENU

FIG. 16

SIMULTANEOUS
COOLING/HEATING ENERGY
CONSERVATION

| | GROUP NAME | COOL /WARM | SIMULTANEOUS OPERATION | TEMPERATURE SETTING |
|---|---|---|---|---|
| ROOM D | GROUP G4<br>GROUP G5<br>GROUP G6 | COOL<br>WARM<br>COOL | ○ | 25℃ |
| ROOM E | GROUP G4<br>GROUP G5<br>GROUP G6 | COOL<br>COOL<br>COOL | × | 25℃ |

SIMULTANEOUS COOLING/
HEATING OPTIMIZATION
COUNTERMEASURE

Cooling and heating are operating simultaneously in room D. It is recommended that the temperature setting in room D be lowered to make the operating mode consistent with either cooling or heating.

SC26

96 MENU

FIG. 18

OPTIMIZATION OF NUMBER OF OPERATING UNITS

OUTDOOR TEMPERATURE 19°C

| | INDOOR UNIT NAME | OUTDOOR TEMPEATURE | | | |
|---|---|---|---|---|---|
| | | 18°C | 19°C | ▪ ▪ ▪ | 28°C |
| ROOM A | INDOOR UNIT 42a | OFF | OFF | | ON |
| | INDOOR UNIT 42b | OFF | OFF | | ON |
| | INDOOR UNIT 42c | OFF | ON | | ON |
| ROOM B | INDOOR UNIT 42d | OFF | OFF | | ON |
| | INDOOR UNIT 42e | OFF | ON | | ON |
| ⋮ | | | | | |

SC17

87 COUNTERMEASURE

FIG. 19

COUNTERMEASURES FOR OPTIMIZING THE NUMBER OF OPERATING UNITS

The number of thermostats that are off in room A has increased. It is recommended that the operation of the indoor units in room A be stopped.

SC27

97 MENU

FIG. 20

AIR CONDITIONING CONTROL DEVICE

CROSS-REFERENCE TO RELATED APPLICATIONS

This U.S. National stage application claims priority under 35 U.S.C. §119(a) to Japanese Patent Application No. 2006-346073, filed in Japan on Dec. 22, 2006, the entire contents of which are hereby incorporated herein by reference.

TECHNICAL FIELD

The present invention relates to an air conditioning control device for obtaining and monitoring operational data related to air conditioners.

BACKGROUND ART

There are conventionally known systems that obtain data such as temperature setting data, power consumption data, and operating mode data from air conditioners and the like when monitoring air conditioners. The monitoring system described in Japanese Laid-Open Patent Publication No. 2004-226062 given below is an example of a system for monitoring abnormal data produced by air conditioners. In this monitoring system, when an abnormality occurs in the air conditioner, details of the abnormality, including data on the occurrence of the abnormality and data on the most recent operating status, are transmitted from a monitoring device that is monitoring the air conditioner to a remote monitoring device. The details on the abnormality that have been transmitted are then stored and collected as needed in the database for the operating data in the remote monitoring device. Onsite service staff members can thereby promptly handle abnormal occurrences by communicating over the internet using a portable terminal in their personal possession to extract and receive data on the operating status from the last 30 minutes to the present from among the details of the abnormality in the database for the operating data. That is, in the process carried out by this monitoring system, data on the operating status within a certain recent time range is extracted from the data that has been collected in the database for the operating data.

SUMMARY OF THE INVENTION

Problems the Invention is Intended to Solve

Recently there has been concern over the depletion of primary energy sources such as fossil fuels, and there is also a need to conserve energy in the interests of cutting down on $CO_2$ (global-warming gas) emissions, and the like. Research is being done on ways to reduce power consumption using operating data such as temperature setting data, power consumption data, and operating mode data of air conditioners and the like in the monitoring systems of the above technology. In view of the foregoing, an object of the present invention is to monitor operating data related to power consumption and the like in air conditioners, and to inform users of the operating status of the air conditioner, leading to lower power consumption.

Means for Solving the Problems

The air conditioning control device according to a first aspect of the invention is an air conditioning control device for obtaining and controlling data on an air conditioner including a plurality of indoor units, the device comprising a data retrieval component, a data collection component, an analysis component, and an analyzed results display component. The data retrieval component retrieves air conditioner operating data including power consumption data for each indoor unit. The data collection component collects operating data at certain periods of time. The analysis component analyzes operating data for each indoor unit. The analyzed results display component visualizes and displays the analyzed data that has been analyzed by the analysis component In the present invention, operating data including air conditioner power consumption data is retrieved and collected, and analyzed data that has been analyzed based on the collected operating data is visualized and displayed by an analyzed results display component. The user can thus ascertain the operating status and can readily implement countermeasures to reduce power consumption.

The air conditioning control device according to a second aspect of the invention is the air conditioning control device according to the first aspect, the device further comprising an power consumption countermeasure table and an extraction component. The power consumption countermeasure table associates the analyzed data with countermeasures for reducing power consumption. The power consumption countermeasure table is countermeasures that allow the power consumption of the air condition as a whole to be reduced. The extraction component extracts the countermeasures for reducing power consumption from the power consumption countermeasure table based on the analyzed data. The analyzed results display component farther displays the countermeasures for reducing power consumption extracted by the extraction component.

In the present invention, pre-determined power consumption countermeasures can be displayed by the analyzed results display component based on the analyzed results. The user can thus effectively implement countermeasures to reduce power consumption in response to the operating status of the air conditioner.

The air conditioning control device according to a third aspect of the invention is the air conditioning control device according to the second aspect, wherein the operating data retrieved by the data retrieval component includes air conditioning temperature setting data, which are the target temperature settings when the indoor units are air conditioning an indoor area. The data collection component associates the air conditioning temperature setting data with the power consumption data to collect the data as temperature setting-power consumption data per indoor unit. The analysis component, based on the temperature setting-power consumption data, selects a certain number of indoor units in order of the greatest power consumption from among indoor units in which the target temperature setting is lower than a first predetermined temperature setting when in cooling operation, and indoor units in which the target temperature setting is over a second predetermined temperature setting when in heating operation. The analysis display component visualizes and further displays the temperature setting-power consumption data of the indoor units selected by the analysis component.

In the present invention, the power consumption data and air conditioning temperature setting data retrieved by the data retrieval component are associated and collected, in the data collection component, as temperature setting-power consumption data for each indoor unit. Based on the collected temperature setting-power consumption data, the analysis component selects a certain number of indoor units in order of the greatest power consumption from among indoor units in which the target temperature setting is lower than a first predetermined temperature setting when in cooling operation, and selects a certain number of indoor units in the order of indoor units with the greatest power consumption from among indoor units in which the target temperature setting is a over second predetermined temperature setting when in heating operation. The temperature setting-power consumption data of the certain number of indoor units selected by the analysis component is further visualized and displayed by the analyzed results display component.

The analysis component can thus select a certain number of indoor units in which the target temperature settings are a temperature that is so low (during cooling operation) or that is so high (during heating operation) that such a temperature cannot be recommended, resulting in a high possibility of wasted energy. The target temperature settings and power consumption of the selected indoor units can also be visualized to notify the user. The user can therefore be notified of indoor units which are highly likely to be wasting energy along with operating data, leading to countermeasures for reducing power consumption.

The air conditioning control device according to a fourth aspect of the invention is the air conditioning control device according to the third aspect, wherein the extraction component extracts, from the power consumption countermeasure table, countermeasures for reducing power consumption that recommend increasing the target temperature settings of the indoor units selected by the analysis component when in cooling operation. The extraction component also extracts, from the power consumption countermeasure table, countermeasures for reducing power consumption that recommend lowering the target temperature settings of the indoor units selected by the analysis component when in heating operation. The analyzed results display component further displays the countermeasures for reducing power consumption that have been extracted by the extraction component.

In the present invention, the user is advised to increase the target temperature settings of the indoor units selected by the analysis component when in cooling operation and to lower the target temperature settings when in heating operation.

The user can thus be presented with countermeasures for reducing power consumption, and not merely shown the operating data of indoor units that are highly likely to be wasting energy. Effective measures for reducing power consumption can thus be presented, and the burden on the user can be alleviated.

The air conditioning control device according to a fifth aspect of the invention is the air conditioning control device according to the second aspect, wherein the operating data retrieved by the data retrieval component includes power demand data which is the power consumption data by time range. The data collection component collects the power demand data as indoor unit power demand data for each indoor unit. The analysis component analyzes the power demand data to calculate the peak production time during which the overall peak power demand for the air conditioner as a whole is produced. The analysis component also selects a certain number of indoor units in order of the greatest indoor unit power demand per indoor unit in the peak production time. The analyzed results display component visualizes and further displays the indoor unit power demand data in peak production time of the indoor units selected by the analysis component.

In the present invention, the power demand data retrieved by the data retrieval component is collected for each indoor unit in the data collection component. Based on the collected power demand data, the analysis component calculates the peak production time during which the overall peak power demand is produced in the air conditioner as a whole, and selects a certain number of indoor units in order of the greatest indoor unit power demand per indoor unit in the peak production time. The indoor unit power demand in the peak production time in the certain number of indoor units selected by the analysis component is furthermore visualized and displayed by the analyzed results display component.

The analysis component can thus select a certain number of indoor units in which the indoor unit power demand is greater in the peak production time, and the overall power demand is highly likely to be significantly affected. The indoor unit power demand of the selected indoor units can also be visualized to alert the user. The user can therefore be notified of indoor units in which the overall power demand is highly likely to be significantly affected, along with the operating data, leading to countermeasures for reducing power consumption.

The air conditioning control device according to a sixth aspect is the air conditioning control device according to the fifth aspect, wherein the extraction component extracts, from the power consumption countermeasure table, countermeasures for reducing power consumption that recommend suppressing and controlling the power demand of the indoor units selected by the analysis component. The analyzed results display component further displays the countermeasures for reducing power consumption that have been extracted by the extraction component.

In the present invention, the user is advised to suppress and control power demand in indoor units selected by the analysis component.

The user can thus be presented with countermeasures for reducing power consumption, and not merely shown the operating data of indoor units in which it is highly likely that overall power demand is significantly affected. Effective measures for reducing power consumption can thus be presented, and the burden on the user can be alleviated.

The air conditioning control device according to a seventh aspect of the invention is the air conditioning control device according to the second aspect, wherein the operating data that has been retrieved by the data retrieval component includes outdoor temperature data. The data collection component associates the outdoor air data and the power consumption data to collect the data as power consumption data by outdoor temperature for each indoor unit. The analysis component analyzes the overall indoor unit trend of the indoor units as a whole and the indoor unit trends of each of the indoor units based on the power consumption data by outdoor temperature. The analysis component also selects a certain number of indoor units in the order of greatest indoor unit trend displacement based on the overall indoor unit trend. The analyzed results display component visualizes and further displays the compared data from the comparison of the indoor unit trends and the overall indoor unit trend of the indoor units which have been selected by the analysis component.

In the present invention, the power consumption data and outdoor temperature data retrieved by the data retrieval component are associated and are collected in the data collection component as power consumption data by outdoor temperature for each indoor unit. Based on the collected power consumption data by outdoor temperature, the analysis component selects a certain number of indoor units in order of indoor units with the greatest displacement in an indoor unit trend based on the overall indoor unit trend. The compared data from the comparison of the indoor unit trends and the overall indoor unit trend of the certain number of indoor units which have been selected by the analysis component is furthermore visualized and displayed by the analyzed results display component.

The analysis component can thus select a certain number of indoor units which are highly likely to be air conditioning indoor areas where there is a substantial external load or internal load. The compared data from the comparison of the indoor unit trends and the overall indoor unit trend of the indoor units which have been selected can be visualized to alert the user. The user can therefore be notified of the indoor units which are highly likely to be air conditioning indoor areas where there is a substantial external load or internal load, along with the operating data, leading to countermeasures for reducing power consumption.

The air conditioning control device according to an eighth aspect of the invention is the air conditioning control device according to the seventh aspect, wherein the extraction component extracts, from the power consumption countermeasure table, countermeasures for reducing power consumption that recommend suppressing the external load on the indoor area being air conditioned by the indoor units selected by the analysis component when there is a significant air conditioning load due to the outdoor temperature. The analyzed results display component further displays the countermeasures for reducing power consumption extracted by the extraction component.

In the present invention, the user is advised, for example, to lower blinds to block externally radiated heat or to lower the level of introduced outdoor air having a substantial load, so as to suppress the external load on the indoor units selected by the analysis component.

The user can thus be presented with countermeasures for reducing power consumption, and not merely shown the operating data of indoor units that are highly likely to be air conditioning indoor areas where there is a substantial external load. Effective measures for reducing power consumption can thus be presented, and the burden on the user can also be alleviated.

In the air conditioning control device according to a ninth aspect of the invention, the extraction component according to the seventh aspect extracts, from the power consumption countermeasure table, countermeasures for reducing power consumption that recommend increasing the level of outdoor air introduced into the indoor area being air conditioned by the indoor units selected by the analysis component when there is a low air conditioning load due to the outdoor temperature. The analyzed results display component further displays the countermeasures for reducing power consumption extracted by the extraction component.

In the present invention, the user is advised to increase the level of outdoor air introduced to the indoor units selected by the analysis component.

The user can thus be presented with countermeasures for reducing power consumption, and not merely shown the operating data of indoor units that are highly likely to be air conditioning indoor areas where there is a substantial internal load. Effective measures for reducing power consumption can thus be presented, and the burden on the user can also be alleviated.

The air conditioning control device according to a tenth aspect of the invention is the air conditioning control device according to the second aspect, wherein the operating data retrieved by the data retrieval component includes change frequency data and changed time range data. The change frequency data is data obtained by counting the number of times the air conditioning temperature settings, which are the target temperature settings, have changed when the indoor units are air conditioning an indoor area. The changed time range data is the time range in which the air conditioning temperature settings have changed. The data collection component associates the change frequency data and the changed time range data to collect the data as change frequency data by time range for each indoor unit. The analysis component selects a certain number of indoor units in the order of greatest overall change frequency for each of the indoor units based on the change frequency data by time range. The analyzed results display component visualizes and further displays the change frequency data by time range for the indoor units that have been selected by the analysis component.

In the present invention, the change data and changed time range data retrieved by the data retrieval component are associated and collected as change frequency data by time range in the data collection component for each indoor unit. Based on the collected change frequency data by time range, the analysis component selects a certain number of indoor units in the order of indoor units with the most frequent overall change frequency in each indoor unit. The change frequency data by time range for the certain number of indoor units that have been selected by the analysis component is further visualized and displayed on the analyzed results display component.

The analysis component thus can select a certain number of indoor units in which the sensory temperature and target temperature settings are highly likely to be not matched. The change frequency data by time range for the indoor units that have been selected can be visualized to notify the user. The user can therefore be notified of the indoor units in which the sensory temperature and target temperature settings are highly likely to be not matched, along with the operating data, leading to countermeasures for reducing power consumption.

The air conditioning control device according to an eleventh aspect of the invention is the air conditioning control device according to the tenth aspect, wherein the extraction component extracts, from the power consumption countermeasure table, countermeasures for reducing power consumption that recommend suppressing the external load on the indoor area being air conditioned by the indoor units selected by the analysis component. The analyzed results display component further displays the countermeasures for reducing power consumption that have been extracted by the extraction component.

In the present invention, the user is advised, for example, to lower blinds to block externally radiated heat or to lower the level of introduced outdoor air having a substantial load, so as to suppress the external load on the indoor units selected by the analysis component.

The user can thus be presented with countermeasures for reducing power consumption, and not merely shown the operating data of indoor units that are highly likely to be air conditioning indoor areas where there is a substantial external load. This can therefore lead to effective countermeasures for reducing power consumption, and can also alleviate the burden on users.

The air conditioning control device according to a twelfth aspect of the invention is the air conditioning control device according to the second aspect, wherein the operating data retrieved by the data retrieval component includes outdoor temperature data and data on times when the thermostat is off for each indoor unit. The data collection component associates the outdoor temperature data and the data on times the thermostat is off, and collects the data as data on times the thermostat is off by outdoor temperature for each indoor unit. The analysis component selects a certain number of indoor units in the order of the longest time for which the thermostat is off by outdoor temperature based on the data on times the thermostat is off by outdoor temperature. The analyzed results display component visualizes and further displays the data on times the thermostat is off by outdoor temperature for the indoor units that have been selected by the analysis component.

In the present invention, the outdoor temperature data and data on times when the thermostat is off that have been retrieved by the data retrieval component are associated and accumulated as data on times the thermostat is off by outdoor temperature for each indoor unit in the data collection component. Based on the collected data on times the thermostat is off by outdoor temperature, the analysis component selects a certain number of indoor units in the order of the indoor units with the longest time for which the thermostat is off by outdoor temperature. The analyzed results display component visualizes and further displays the data on times the thermostat is off by outdoor temperature for the indoor units that have been selected by the analysis component.

The analysis component can thus select a certain number of indoor units for which the thermostat will be off for a long time and air will highly likely be blown wastefully. The data on times the thermostat is off by outdoor temperature for the indoor units that have been selected can be visualized to notify the user. The user can therefore be notified of the indoor units for which the thermostat will be off for a long time and air will highly likely be blown wastefully, along with the operating data, leading to countermeasures for reducing power consumption.

The air conditioning control device according to a thirteenth aspect of the invention is the air conditioning control device according to the twelfth aspect, wherein the extraction component extracts, from the power consumption countermeasure table, countermeasures for reducing power consumption that recommend stopping the operation of the indoor units selected by the analysis component. The analyzed results display component further displays the countermeasures for reducing power consumption that have been extracted by the extraction component.

In the present invention, the user is advised to stop the operation of indoor units selected by the analysis component.

The user can thus be presented with countermeasures for reducing power consumption, and not merely shown the operating data of indoor units that are highly likely to be only blowing air wastefully. This can therefore lead to effective countermeasures for reducing power consumption, and the burden on the user can also be alleviated.

The air conditioning control device according to a fourteenth aspect of the invention is the air conditioning control device according to the twelfth or thirteenth aspect, further comprising a control component for stopping the indoor units selected by the analysis component based on the data on times the thermostat is off.

The present invention further comprises a control component for automatically stopping the operation of indoor units selected by the analysis component. Indoor units that are highly likely to be only blowing air wastefully can therefore be stopped automatically without the user having to stop them. The burden on the user can therefore be alleviated.

EFFECTS OF THE INVENTION

The air conditioning control device according to the first aspect of the invention allows users to ascertain the operating status and to readily implement countermeasures for reducing power consumption.

The air conditioning control device according to the second aspect of the invention allows users to effectively implement countermeasures for reducing power consumption in response to the operating status of the air conditioner.

The air conditioning control device according to the third aspect of the invention, the analysis component can select a certain number of indoor units in which the target temperature settings are a temperature that is so low (during cooling operation) or that is so high (during heating operation) that such a temperature cannot be recommended, resulting in a high possibility of wasted energy. The target temperature settings and power consumption of the selected indoor units can also be visualized to notify the user. The user can therefore be notified of indoor units which are highly likely to be wasting energy along with operating data, leading to countermeasures for reducing power consumption.

The air conditioning control device according to the fourth aspect of the invention allows the user to be presented with countermeasures for reducing power consumption, and not merely shown the operating data of indoor units that are highly likely to be wasting energy. Effective measures for reducing power consumption can thus be presented, and the burden on the user can be alleviated.

The air conditioning control device according to the fifth aspect, the analysis component can select a certain number of indoor units in which the indoor unit power demand is greater in the peak production time, and the overall power demand is highly likely to be significantly affected. The indoor unit power demand data of the selected indoor units can also be visualized to alert the user. The user can therefore be notified of indoor units in which the overall power demand is highly likely to be significantly affected, along with the operating data, leading to countermeasures for reducing power consumption.

The air conditioning control device according to the sixth aspect of the invention allows the user to be presented with countermeasures for reducing power consumption, and not merely shown the operating data of indoor units in which it is highly likely that overall power demand is significantly affected. Effective measures for reducing power consumption can thus be presented, and the burden on the user can also be alleviated.

The air conditioning control device according to the seventh aspect of the invention, the analysis component can select a certain number of indoor units which are highly likely to be air conditioning indoor areas where there is a substantial external load or internal load. The compared data from the comparison of the indoor unit trends and the overall indoor unit trend of the indoor units which have been selected can be visualized to alert the user. The user can therefore be notified of the indoor units which are highly likely to be air conditioning indoor areas where there is a substantial external load or internal load, along with operating data, leading to countermeasures for reducing power consumption.

The air conditioning control device according to an eighth aspect of the invention allows the user to be presented with countermeasures for reducing power consumption, and not merely shown the operating data of indoor units that are highly likely to be air conditioning indoor areas where there is a substantial external load. Effective measures for reducing power consumption can thus be presented, and the burden on the user can also be alleviated.

The air conditioning control device according to a ninth aspect of the invention allows the user to be presented with countermeasures for reducing power consumption, and not merely shown the operating data of indoor units that are highly likely to be air conditioning indoor areas where there is a substantial internal load. Effective measures for reducing power consumption can thus be presented, and the burden on the user can also be alleviated.

The air conditioning control device according to a tenth aspect of the invention, the analysis component can select a certain number of indoor units in which the sensory temperature and target temperature settings are highly likely to be not matched. The change frequency data by time range for the indoor units that have been selected can be visualized to notify the user. The user can therefore be notified of the indoor units in which the sensory temperature and target temperature settings are highly likely to be not matched, along with the operating data, leading to countermeasures for reducing power consumption.

The air conditioning control device according to an eleventh aspect of the invention allows the user to be presented with countermeasures for reducing power consumption, and not merely shown the operating data of indoor units that are highly likely to be air conditioning indoor areas where there is a substantial external load. This can therefore lead to effective countermeasures for reducing power consumption, and can also alleviate the burden on users.

The air conditioning control device according to the twelfth aspect of the invention, the analysis component can select a certain number of indoor units for which the thermostat will be off for a long time and air will highly likely be blown wastefully. The data on times the thermostat is off by outdoor temperature for the indoor units that have been selected can be visualized to notify the user. The user can therefore be notified of the indoor units for which the thermostat will be off for a long time and air will highly likely be blown wastefully, along with the operating data, leading to countermeasures for reducing power consumption.

The air conditioning control device according to the thirteenth aspect of the invention can allow the user to be presented with countermeasures for reducing power consumption, and not merely shown the operating data of indoor units that are highly likely to be only blowing air wastefully. This can therefore lead to effective countermeasures for reducing power consumption, and the burden on the user can also be alleviated.

The air conditioning control device according to the fourteenth aspect of the invention allows indoor units that are highly likely to be only blowing air wastefully to be stopped automatically without the user having to stop the units. The burden on the user can therefore be alleviated.

BRIEF DESCRIPTION OF THE DRAWINGS

FIG. 7 is a wasteful operating elimination countermeasure screen.

FIG. 10 is a peak power countermeasure screen.

FIG. 14 is a comfort maintenance countermeasure screen.

FIG. 16 is an outdoor air introduction countermeasure screen.

FIG. 18 is a simultaneous cooling/heating operation optimization countermeasure screen.

FIG. 19 is a screen for optimizing the number of operating units.

FIG. 20 is a countermeasure screen for optimizing the number of operating units in modification (3).

DETAILED DESCRIPTION OF THE INVENTION

Schematic Structure of Air Conditioning Monitor/Support System

Figure 1:
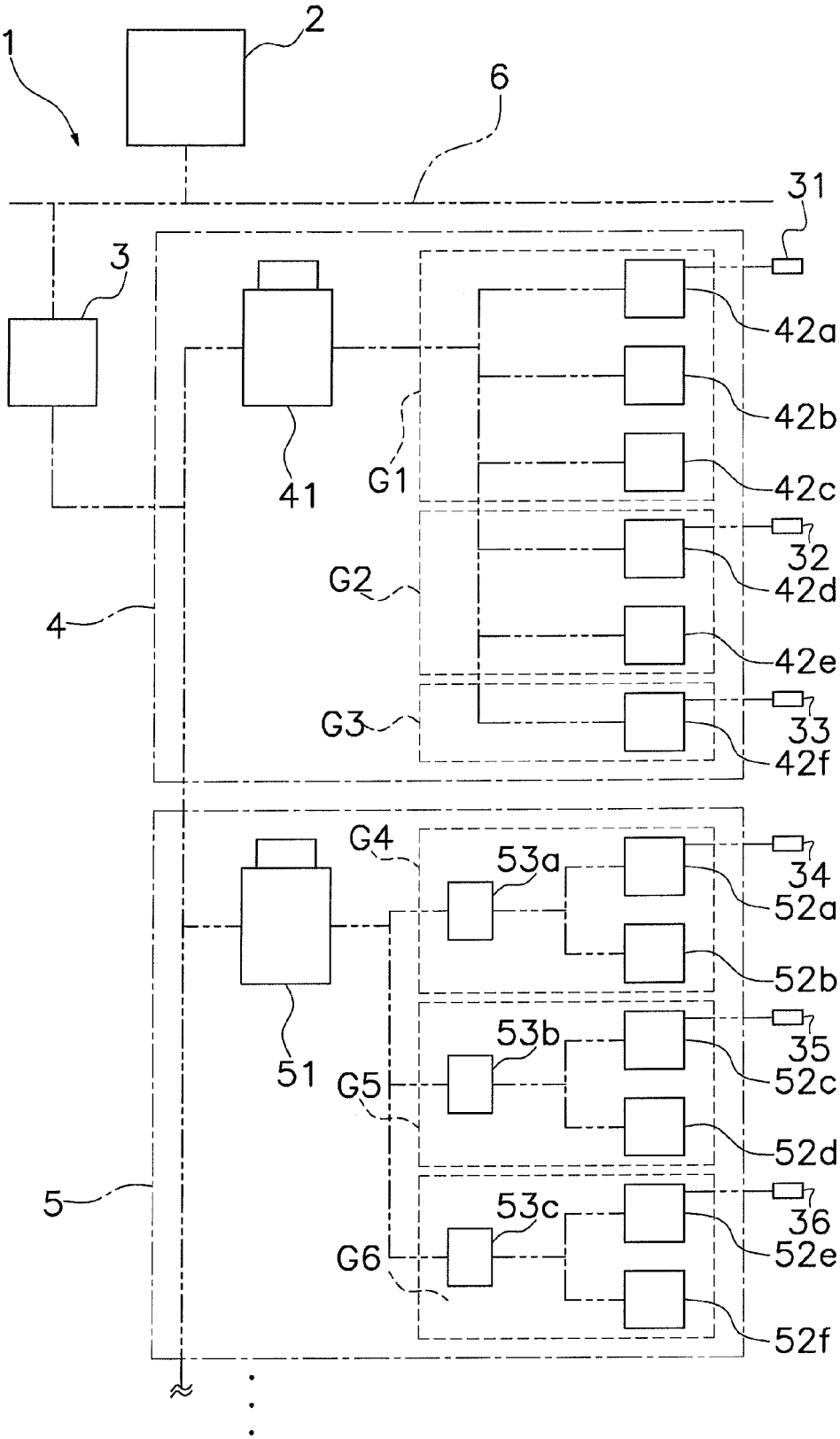
FIG. 1 is a schematic structural diagram of an air conditioning monitor/support system according to the present embodiment.

The air conditioning monitor/support system according to the present invention is an air conditioning monitor/support system which is mounted in an office building or the like, as illustrated in FIG. 1, and is composed primarily of a monitor device 2, central remote control 3, a first air conditioner 4 and a second air conditioner 5 as two systems, and an air conditioning network 6. In the air conditioner monitor/support system 1, the first air conditioner 4 and second air conditioner 5 are connected by the air conditioning network 6 to the monitor device 2. The first air conditioner 4 and second air conditioner 5 are each monitored by the monitor device 2.

The air conditioner monitor/support system 1 is a system for retrieving operating data such as the operating status or operating condition of the air conditioners 4 and 5, performing certain processes on the retrieved data in order to monitor the air conditioners 4 and 5, visualizing the operating data related to the air conditioners 4 and 5, displaying countermeasures leading to energy conservation, and encouraging users such as building administrators to adopt energy conservation measures.

(1) Schematic Structure of Air Conditioning Control Device

The monitor device 2 is composed of a data processor 21, memory 22, display component such as a display (output component) 23, communications component 24 such as a communications interface, keyboard 25, mouse 26, control component 27, and the like.

The data processor 21 derives certain types of data by computing and processing various types of data obtained from the memory 22 or communications component 24, such as operating data processing, extraction processing, and display processing, according to a computing program stored in the memory 22, and transmits the data to the memory 22, display component 23, and communications component 24.

The memory 22 stores data related to the air conditioners 4 and 5, such as tables needed to control the first air conditioner 4 and second air conditioner 5, position data and grouping data, which are needed for communication with the first air conditioner 4 and second air conditioner 5 or the like. The memory 22 stores air conditioning status data, which is daily data for each of the air conditioners 4 and 5. From the air conditioners 4 and 5, various types of data (see description below) related to the operating status or operating condition of the air conditioners 4 and 5 are stored in the memory 22 via the communications component 24. Also stored there is a power consumption countermeasure table 22*a* in which the results of operating data analysis described below are associated with the optimal power consumption countermeasure corresponding to the results of analysis.

The display component 23 outputs displays such as those in FIGS. 5 through 20 in response to processing from the data processor 21 based on data recorded in the memory 22 (see below).

The control component 27 controls the air conditioners 4 and 5 according to a program, operating data, or the like stored in the memory 22.

(2) First Air Conditioner

Figure 2:
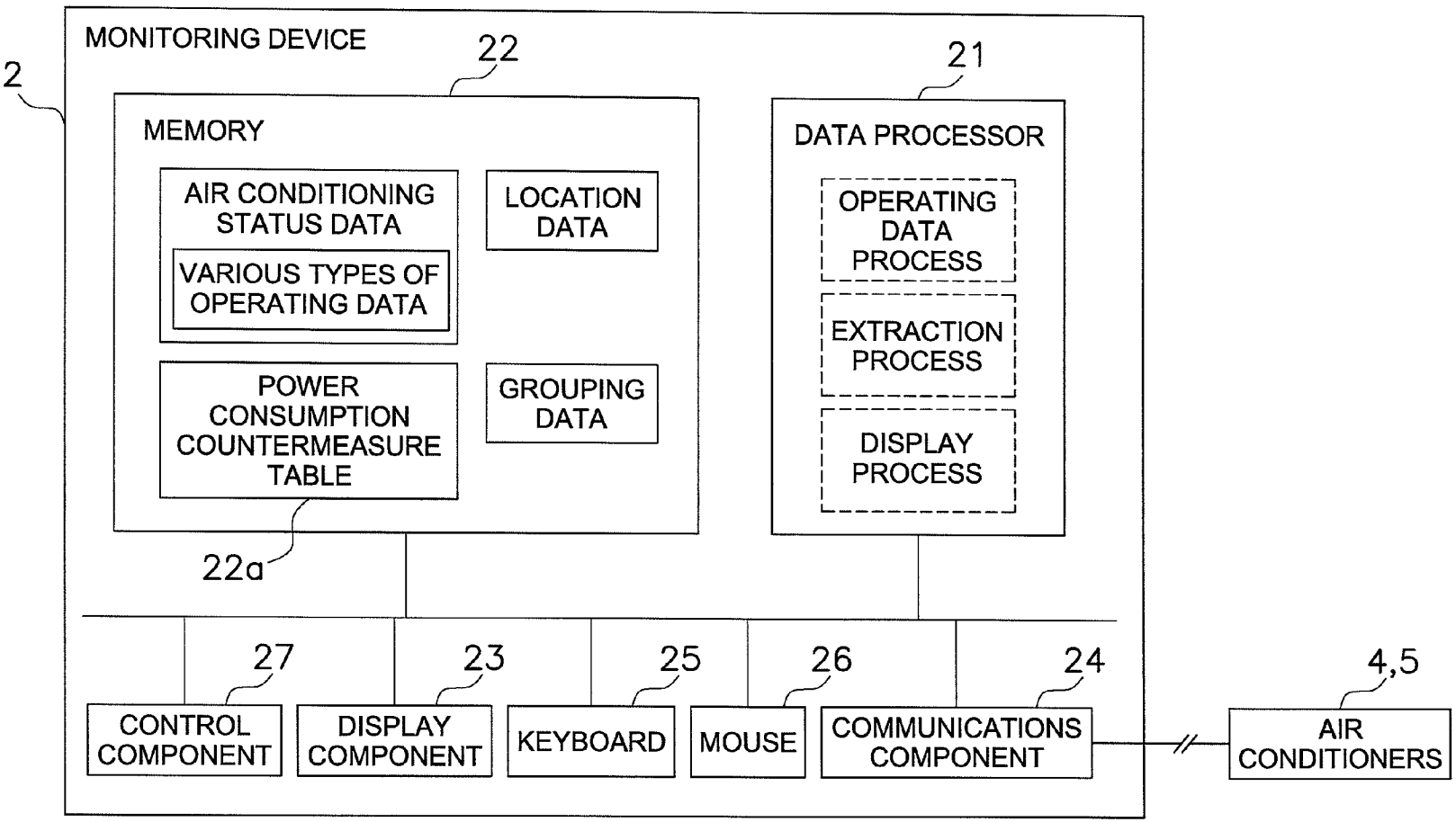
FIG. 2 is a schematic structural diagram of a monitoring device.
Figure 3:
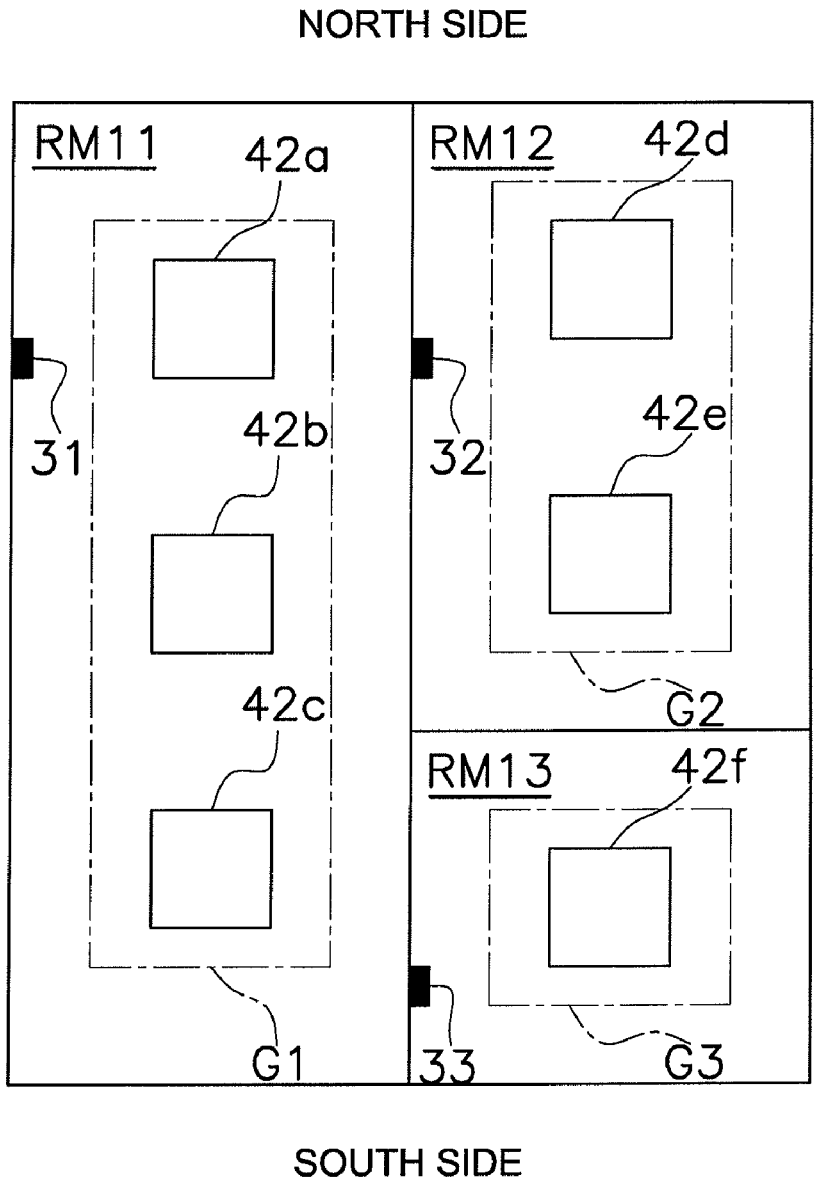
FIG. 3 is a first story plan of a building (layout of first air conditioner).

FIG. 3 is a first story plan of a building (not shown) in which the air conditioner monitor/support system 1 of this embodiment is set up. The first air conditioner 4 is located on the first floor of a building, as shown in FIG. 3. The first air conditioner 4 is an apparatus referred to as a multi-type air conditioner with a plurality of indoor units 42*a* through 42*f* connected to an outdoor unit 41. This is an air conditioner that is capable of cooling and heating by switching between operation modes such as a cooling operation mode and heating operation mode. The first floor of the building is divided, as illustrated in FIG. 3, into three rooms: a room A RM11, room B RM12, and room C RM 13. As illustrated in FIGS. 1 and 2, the first air conditioner 4 is composed primarily of an outdoor unit 41, a plurality of indoor units 42*a* through 42*f* (six according to the present embodiment), and a plurality of wired remote controls 31 through 33 (three according to the present embodiment). The plurality of indoor units 42*a* through 42*f* is connected to the same outdoor unit 41 and is related to the same air conditioning system (first floor air conditioning system). The outdoor unit 41, plurality of indoor units 42*a* through 42*f*, and wired remote controls 31 through 33 are mutually connected through the air conditioning network 6. Of the plurality of indoor units 42*a* through 42*f*, three (indoor units 42*a* through 42*c*) are located in room A RM11, two (indoor units 42*d* and 42*e*) are located in room B RM12, and one (indoor unit 42*f*) is located in room C RM13. These indoor units 42*a* through 42*f* are divided into groups for each room, where the indoor units 42*a* through 42*c* set up in room A RM11 are stored as Group G1, the indoor units 42*d* and 42*e* set up in room B RM12 are stored as Group G2, and the indoor unit 42*f* set up in room C RM13 is stored as Group G3 in a grouping data in the memory 22. According to the present embodiment, moreover, the three indoor units 42*a* through 42*c* in room A RM11 are controlled by the monitor device 2 and the wired remote control 31 set up in room A RM11. The two indoor units 42*d* and 42*e* in room B RM12 are controlled by the monitor device 2 and the wired remote 32 set up in the room B. The indoor unit 42*f* in room C RM13 is controlled by the monitor device 2 and the wired remote 33 set up in room C.

(3) Second Air Conditioner (Simultaneous Cooling and Heating Operation)

Figure 4:
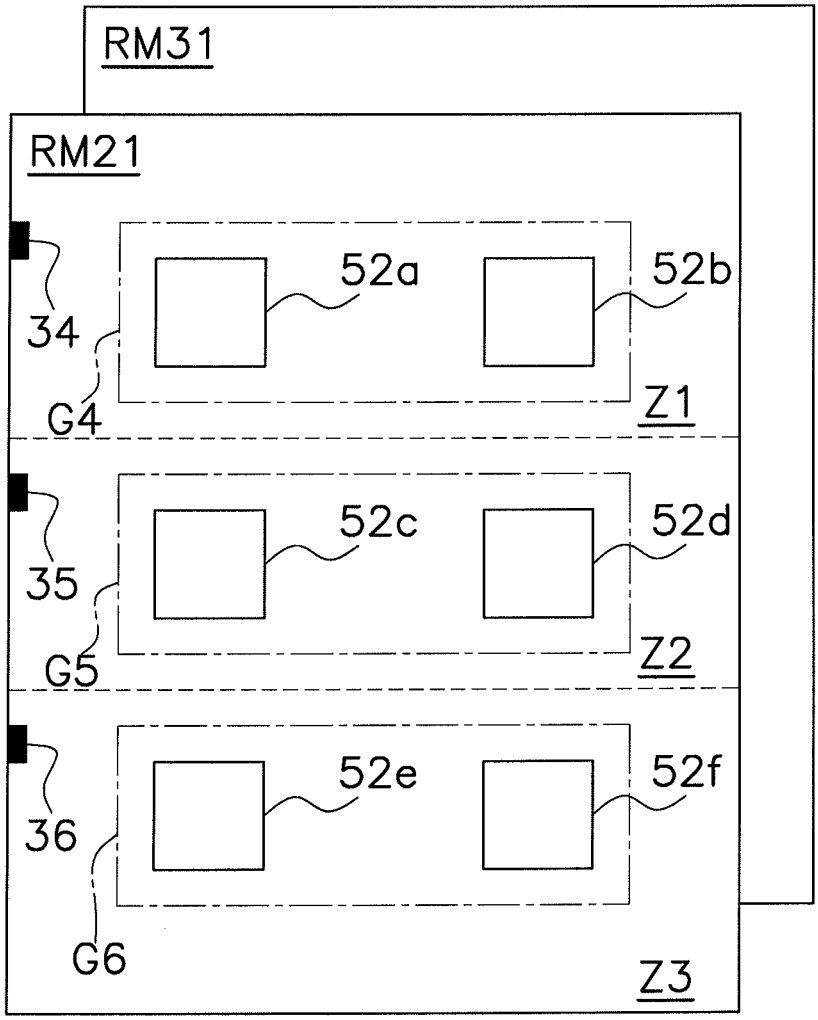
FIG. 4 is a second and third story plan of a building (layout of second air conditioner).
Figure 5:
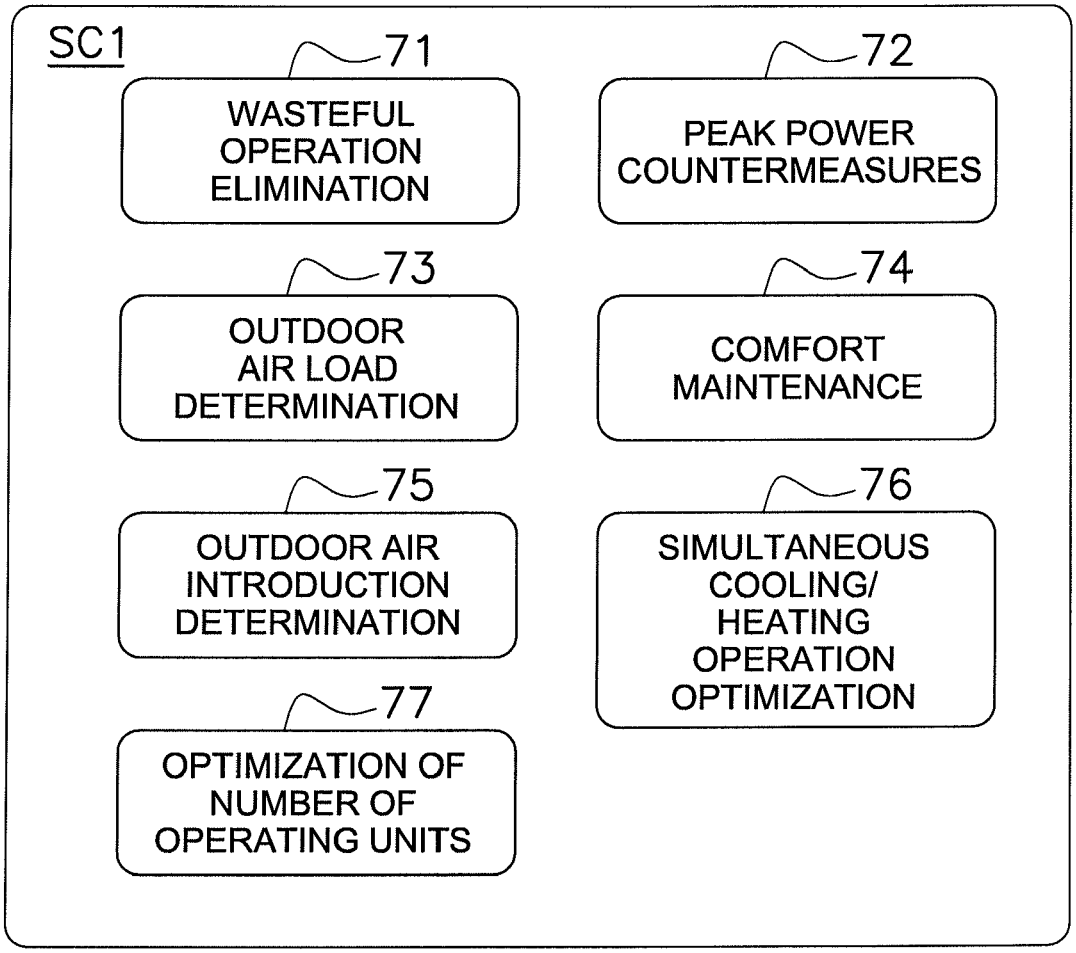
FIG. 5 is a countermeasure mode selection screen.

FIG. 4 is a second and third story plan of a building in which the air conditioner monitor/support system 1 according to this embodiment is set up. The second air conditioner 5 is an apparatus referred to as a multi-type air conditioner with a plurality of indoor units 52*a* through 52*f* connected to an outdoor unit 51 located on the second and third floors of the building according to the present embodiment. This is a multi-air conditioner capable of performing the simultaneous cooling and heating operation in which cooling and heating are automatically switched therebetween according to temperature settings. The second air conditioner 5 set up on the third floor is the same structure as on the second floor. Only the second air conditioner 5 on the second floor will be described here. As illustrated in FIG. 4, the second floor of the building is only a single large room D RM21 (the third floor is room E RM31), and six second air conditioners 5 are set up in the room D RM21. The room D RM21 is divided into three imaginary zones: a north zone Z1 on the north side, a middle zone Z2 in the middle of the room D RM21, and a south zone Z3 on the south side. As illustrated in FIGS. 1 and 2, the second air conditioner 5 is composed primarily of an outdoor unit 51, a plurality of indoor units 52*a* through 52*f* (six according to the present embodiment), a plurality of switching units 53*a* through 53*c* (three according to the present embodiment), and a plurality of wired remote controls 34 through 36 (three according to the present embodiment). The plurality of indoor units 52*a* through 52*f* is connected to the same outdoor unit 51 and is related to the same air conditioning system (second or third floor air conditioning system). The outdoor unit 51, plurality of indoor units 52*a* through 52*f*, and wired remote controls 34 through 36 are mutually connected through the air conditioning network 6. Two each of the plurality of indoor units 52*a* through 52*f* are located in groups of two in each of the three divided zones, where indoor units 52*a* and 52*b* in the north zone Z1 are stored as group G4, indoor units 52*c* and 52*d* in the middle zone Z2 are stored as group G5, and indoor units 52*e* and 52*f* in the south zone Z3 are stored as group G6 in the grouping data in the memory 22. The three corresponding switching units 53*a* through 53*c* are connected to the groups G4 through G6, respectively, where the switching unit 53*a* is connected to the indoor units 52*a* and 52*b* of the group G4, the switching unit 53*b* is connected to the indoor units 52*c* and 52*d* of the group G5, and the switching unit 53*c* is connected to the indoor units 52*e* and 52*f* of the group G6. The switching units 53*a* through 53*c* are also units capable of switching between cooling operation and heating operation in response to temperature settings set by the user. According to the present embodiment, moreover, the two indoor units 52*a* and 52*b* of group G4 are controlled by the monitor device 2 and the wired remote control 34 set up in the north zone Z1. The two indoor units 52*c* and 52*d* in the group G5 are controlled by the monitor device 2 and the wired remote 35 set up in the middle zone Z2. The two indoor units 52*e* and 52*f* in the group G6 are controlled by the monitor device 2 and the wired remote 36 set up in the south zone Z3.

Monitoring of Air Conditioners

As noted above, the monitor device 2 retrieves air conditioner operating data from the air conditioners 4 and 5 through the communications component 24. Specifically, the monitor device 2 retrieves operating data for each of the air conditioners 4 and 5 from the air conditioners 4 and 5, and stores the data in memory 22. Here, a year of operating data is retrieved for each of the indoor units 42*a* through 42*f* and 52*a* through 52*f* of the air conditioners 4 and 5. The period of time for retrieving operating data here is not limited to one year and can be set by the user, for example to six months, a year and a half, or two years. The operating data includes power consumption data, air conditioning temperature setting data, power demand data, outdoor temperature data, change frequency data, changed time range data, and data on times when the thermostat is off. What is referred to here as "power consumption data" is data on the energy consumed by each of the indoor units 42*a* through 42*f* and 52*a* through 52*f*. What is referred to here as "air conditioning temperature setting data" is the target temperature setting when indoor areas are being air conditioned by the indoor units 42*a* through 42*f* and 52*a* through 52*f*, which the user can set by remote control or air conditioning control device input component. What is referred to here as "power demand data" is data on the power demanded by each of the indoor units 42*a* through 42*f* and 52*a* through 52*f*. What is referred to here as "outdoor temperature data" is data on the outdoor temperature detected by a temperature sensor located in an outdoor unit or the like. What is referred to here as "change frequency data" is data obtained by counting the number of times the air conditioning temperature setting is changed per day for each of the indoor units 42*a* through 42*f* and 52*a* through 52*f*. What is referred to as "changed time range data" is data on the time range in which the air conditioning temperature setting has been changed. What is referred to as "data on times when the thermostat is off" is data in which the thermostat off status of the indoor units and the outdoor temperature data of the indoor units 42*a* through 42*f* and 52*a* through 52*f* in which the thermostat was off throughout the day are associated on a room by room basis. The data processor 20 graphs each type of operating data stored in the memory 30 in order to be displayed in the power consumption countermeasure mode described below (there is no actual need for display output, as long as the data is appropriately processed). The keyboard 25 or mouse 26, which are input devices of the monitor device 2 or central remote control 3, can also be used for input by the user to allow power consumption countermeasures from the results analyzed in each power consumption countermeasure mode (see below) to be displayed based on the power consumption countermeasure table 22*a* stored in the memory 22.

Various power consumption countermeasure modes will be described below. The power consumption countermeasure modes are the seven modes described below. The seven modes are illustrated in sequence using FIGS. 5 through 20. The seven modes can be selected from a countermeasure mode selection screen SC1 (see FIG. 5), which is the initial screen showing the power consumption countermeasure modes. Each button 71 through 77 on the countermeasure mode selection screen SC1 can be selected to move to the screen showing the seven power consumption countermeasure modes described below.

(1) Wasteful Operation Elimination Mode

In the countermeasure mode selection screen SC1 (see FIG. 5), the wasteful operation elimination button 71 is selected to switch to a screen SC11 that displays power consumption classified by temperature setting. In the screen SC11 that displays power consumption classified by temperature setting, analyzed temperature setting-power consumption data is visualized as in FIG. 6, and is displayed on the display component 23.

(1-1) Determination of Analysis Target Period

According to the present embodiment, as noted above, the air conditioners 4 and 5 have been operated for a year, and operating data has been previously stored in the memory 22. The temperature setting-power consumption data is analyzed based on the data for the previous year according to the season for which the wasteful operation elimination button 71 has been selected. The seasons are classified into three patterns: summer (cooling operation period), winter (heating operation period), and an interim period, where summer is the period from June to August, winter is the period that spans December, January, and February, and the interim period is the period from March to May and from September to November. The user can also change the summer, winter, and interim periods to any period by means of an input device such as the keyboard 25 or mouse 26.

When, for example, the wasteful operation elimination button 71 is selected on Jul. 20, 2006, since the season is summer, the operating data collected from Jun. 1, 2005 to Aug. 31, 2005 will be analyzed as part of the previous year of operating data.

(1-2) Automatic Analysis and Display of Analyzed Results

Figure 6:
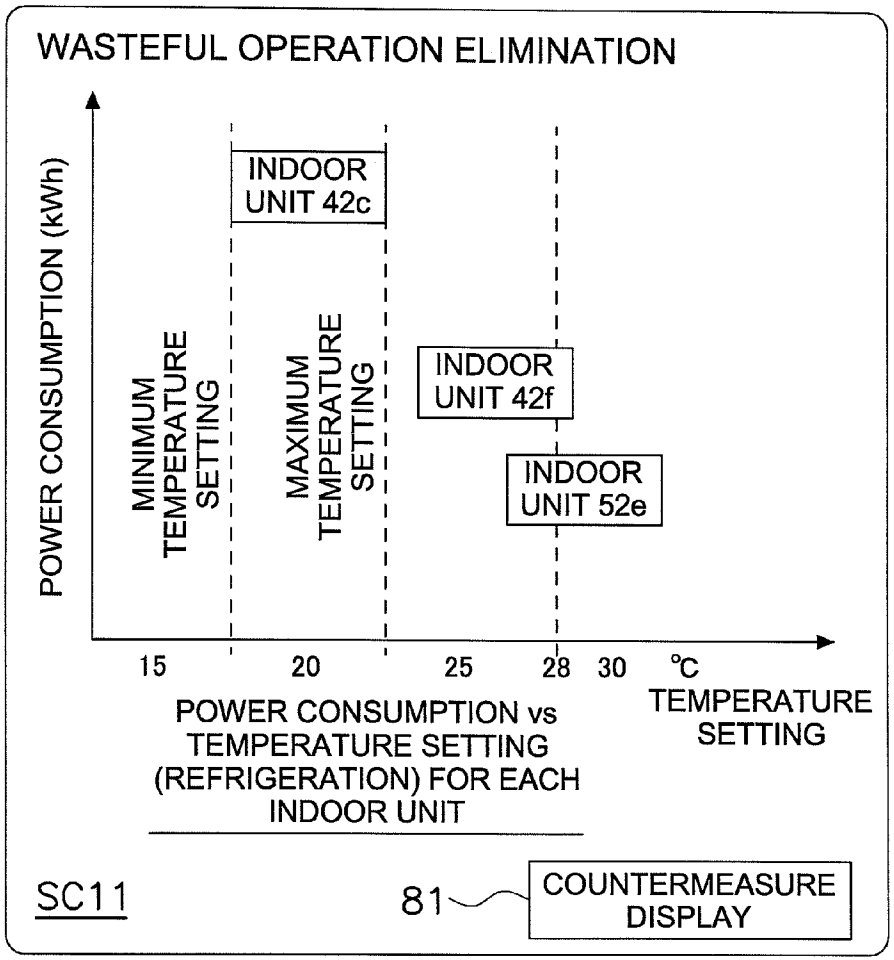
FIG. 6 is a screen showing power consumption by temperature setting.

In the analysis of the operating data, a maximum of three indoor units are selected in order of the greatest power consumption, 42*c*, 42*f*, and 52*e*, from among the indoor units in which the air conditioning temperature setting of each indoor unit 42*a* through 42*f* and 52*a* through 52*f* has been set below 28° C. These are displayed along with a graph, as shown in FIG. 6. FIG. 6 is a graph in which the air conditioning temperature settings of the indoor units 42*a* through 42*f* and 52*a* through 52*f* are shown on the horizontal axis, and the power consumption is shown on the vertical axis. In the graph, the indoor unit that is highly likely to be wasting energy can be extracted because the indoor unit 42*c* with particularly high power consumption can be selected from among the indoor units in which the highest temperature setting is below 28° C. in cooling operation; that is, the indoor units in which it is highly likely that the air conditioning temperature setting has been set too low. What is referred to here as the "highest temperature setting" is the air conditioning temperature setting that is the highest among the air conditioning temperature settings which have been set by the user. Here, the indoor unit 42*c* has been extracted. Although a maximum of three indoor units which the results of analysis indicate as having significant power consumption are used here, the user can specify a different number than 3, such as 1, 2, or 4, as needed. In addition, the example here is of cooling operation, but the analysis is done in the same manner for heating operation, in which case a maximum of three indoor units with an air conditioning temperature setting greater than 24° C. will be selected in the order of greatest power consumption.

(1-3) Countermeasure Display

The countermeasure display button 81 in the lower right of the screen SC11 that displays power consumption classified by temperature setting is pressed to display a wasteful operation elimination countermeasures screen SC21 for the indoor unit 42*c* that has been extracted in the results of analysis (see FIG. 7). Here, the wasteful operation elimination countermeasures screen SC21 displays the message "The power consumption of the indoor unit 42*c* has increased because the temperature setting is low. It is recommended that the remote control temperature setting be increased." The user can therefore take specific measures to reduce the power consumption in response to the results of analysis noted above. Not only may the above measures be taken, but maximum and minimum air conditioning temperature settings may be established to limit the air conditioning temperature settings so that no user other than the air conditioning administrator can modify the settings. The menu button 91 in the lower right of the wasteful operation elimination countermeasures screen SC21 is pushed to return to the countermeasure mode selection screen SC1.

(2) Peak Power Mode

Figure 8:
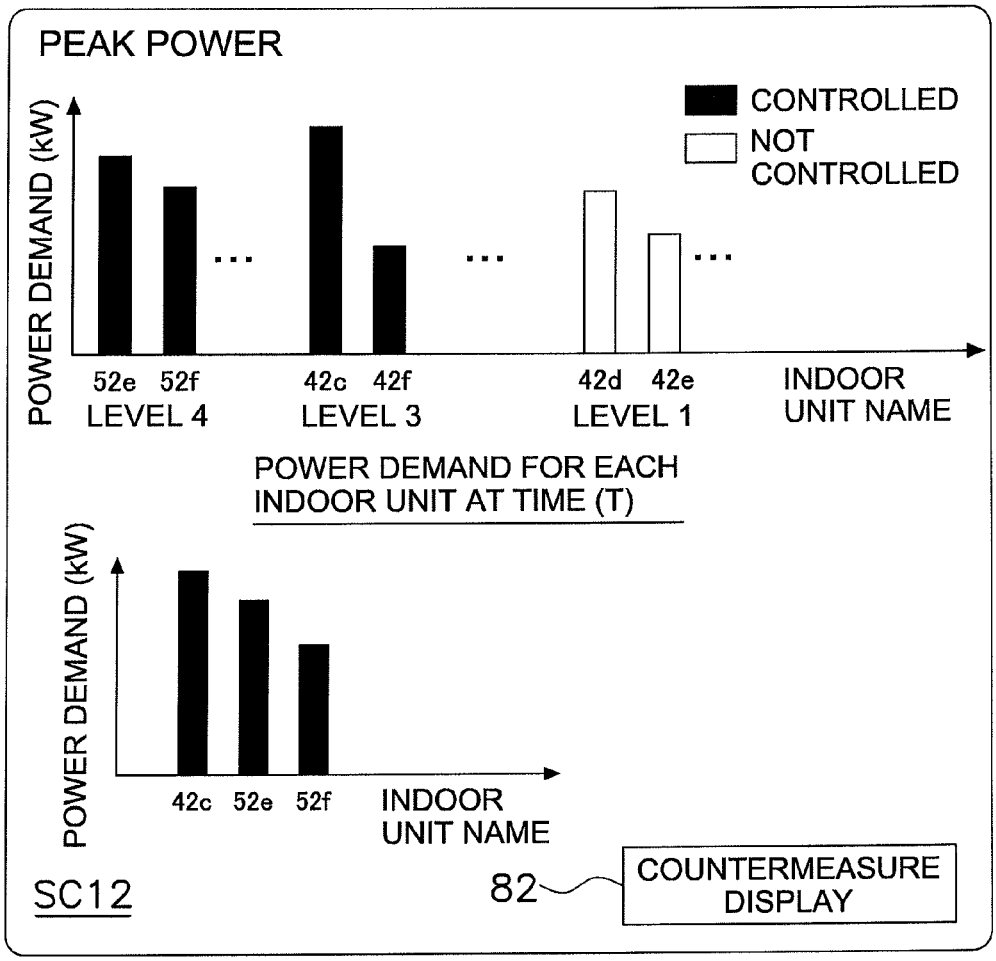
FIG. 8 is a peak power screen.
Figure 9:
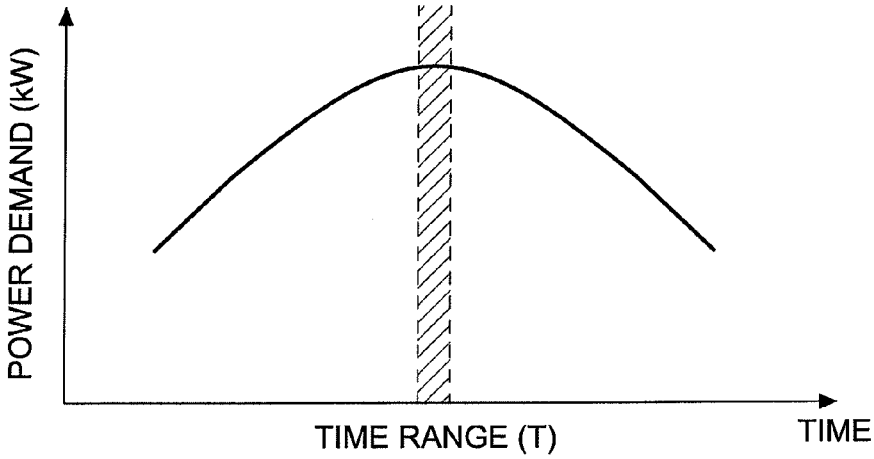
FIG. 9 is a power demand curve for Aug. 20, 2006.

In the countermeasure mode selection screen SC1, the peak power display button 72 is selected to switch to a peak power screen SC12. In the peak power screen SC12, the analyzed power demand data is visualized as shown in FIG. 8 and is displayed on the display component 23.

(2-1) Determination of Analysis Target Period

According to the present embodiment, as noted above, the air conditioners 4 and 5 have been operated for a year, and operating data has been previously stored in the memory 22. The power demand data is analyzed based on the operating data for the previous year.

(2-2) Automatic Analysis and Display of Analyzed Results

In the analysis of the operating data, a time range T (30 minutes) in which power demand has peaked among the days with the greatest power demand peak for the first air conditioner 4 and second air conditioner 5 combined (see FIG. 9) is extracted from the operating data for the previous year. Three indoor units are extracted in the order of greatest power demand in this time range T.

When, for example, the peak power countermeasure display button is selected for Sep. 15, 2006, the day with the greatest power demand peak in the operating data in the previous year from that date is extracted. If the power demand peak was greatest on Aug. 20, 2006, then Aug. 20, 2006 will be extracted. When the time range in which power demand peaked on Aug. 20, 2006 was between 2:30 PM and 3:00 PM, three indoor units are extracted in the order of greatest power demand from the time range of 2:30 PM to 3:00 PM on Aug. 20, 2006.

The power demand control is described here. Power demand is controlled for the indoor units 42*a* through 42*f* and 52*a* through 52*f* of the air conditioners 4 and 5 which are determined to be over a maximum power demand, and the air conditioners 4 and 5 are controlled so that the overall power demand will not be more than the maximum power demand. That is, when it appears as if the power demand will be over the maximum, the energy to the air conditioners 4 and 5 is conserved, power consumption is economized, and the power demand is controlled so as not to be over the maximum power demand in that time range. During power demand control, the rooms in which an air conditioner is located are divided into levels by the user according to the level of need for air conditioning. According to the present embodiment, for example, room A RM11 is level 3, room B RM12 is level 1, room C is level 3, and room D is level 4. The power demand is not controlled in level 1 indoor units 42*d* and 42*e*. When the power demand is controlled in the level 2 indoor units (no applicable indoor units), the air conditioning temperature setting is increased 1° C. When the power demand is controlled in the level 3 indoor units 42*a* through 42*c* and 42*f*, the air conditioning temperature setting is increased 2° C. In the level 4 indoor units 52*a* through 52*f*, the air conditioning temperature setting is increased 3° C. When the power demand is controlled in the level 5 indoor units (no applicable indoor units), the air conditioning temperature setting is increased 4° C. In the peak power screen SC12, the results are graphed in order of indoor units with the greatest power demand by level in the upper portion of the peak screen SC12, and the three indoor units 42*c*, 52*e*, and 52*f* are extracted in order of the greatest power demand in the bottom portion of the peak screen SC12.

(2-3) Countermeasure Display

The countermeasure display button 82 in the lower right of the peak power screen SC12 is pressed to display countermeasures for reducing the power demand in the indoor units 42*c*, 52*e*, and 52*f* that were extracted in the results of analysis. Here, a peak power countermeasures screen SC22 displays this message for the indoor unit 42*c*: "Because the power demand in the indoor unit 42*c* is high, it is recommended that the power demand control level in the room A be increased to level 4"; displays this message for the indoor unit 52*e*: "Because the power demand in the indoor unit 52*e* is high, it is recommended that the power demand control level in room D be increased to level 5"; and displays this message for the indoor unit 52*f*: "Because the power demand in the indoor unit 52*f* is high, it is recommended that the power demand control level in room D be increased to level 5" (see FIG. 10). The user can thus take specific measures for reducing the power demand in response to the results of analysis above. The menu button 92 in the lower right of the peak power countermeasures screen SC22 is pressed to return to the countermeasure mode selection screen SC1.

(3) Outdoor Air Load Determination Mode

Figure 11:
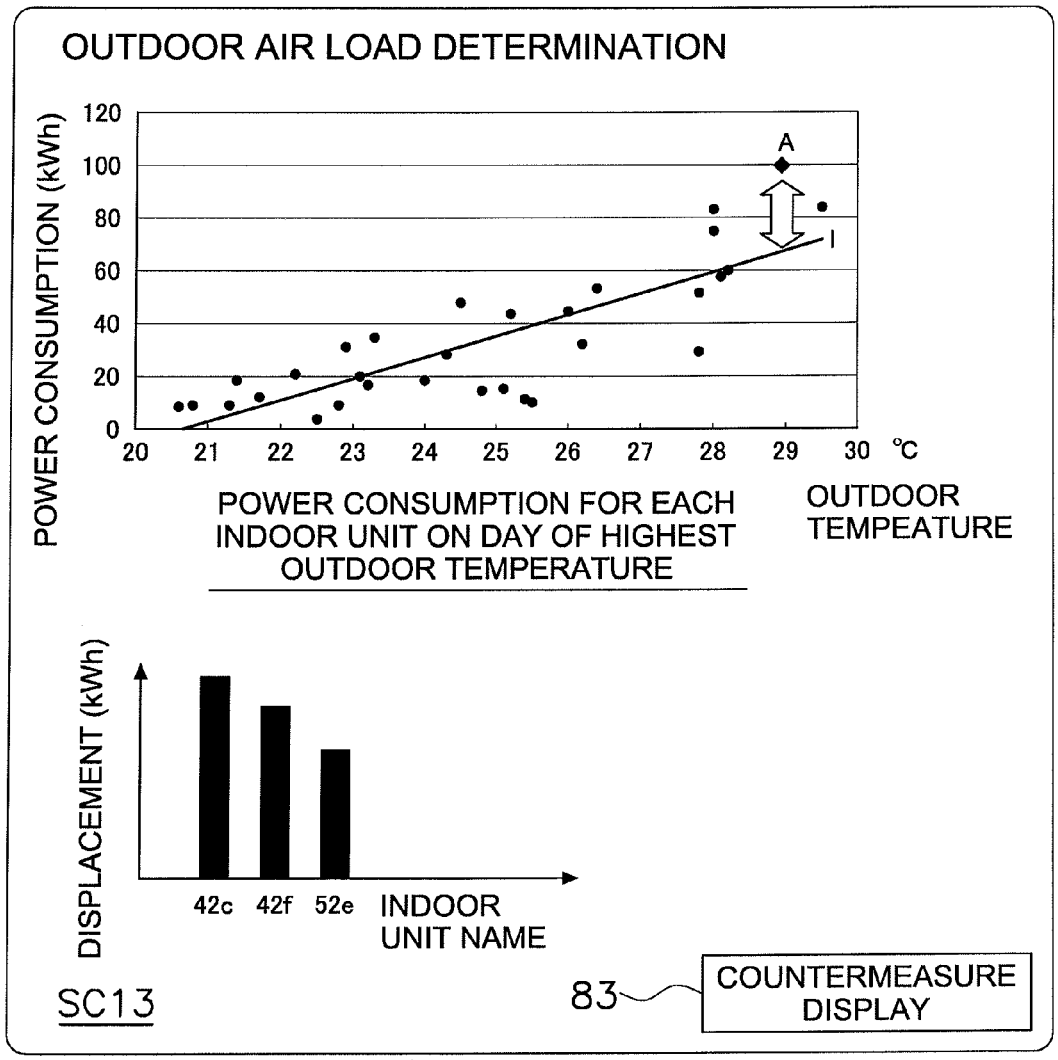
FIG. 11 is an outdoor air load determination screen.

In countermeasure mode selection screen SC1, the outdoor air load determination button 73 is selected to switch to the outdoor air load determination screen SC13. In the outdoor air load determination screen SC13, the analyzed power consumption data by outdoor temperature is visualized as shown in FIG. 11 and is displayed on the display component 23.

(3-1) Determination of Analysis Target Period

According to the present embodiment, as noted above, the air conditioners 4 and 5 have been operated for a year, and operating data has been previously stored in the memory 22. The data is analyzed based on the data for the previous year according to the season for which the outdoor air load determination button 73 has been selected. The seasons are classified into three patterns: summer (cooling operation period), winter (heating operation period), and an interim period, where summer is the period from June to August, winter is the period that spans the three months of December, January, and February, and the interim period is the period from March to May and from September to November. The outdoor air load determination mode is also a mode that is limited to summer or winter.

When, for example, the outdoor air load determination button 73 is selected on Jul. 20, 2006, since the season is summer, the operating data collected from Jun. 1, 2005 to Aug. 31, 2005 among the previous year of data is analyzed.

(3-2) Automatic Analysis and Display of Analyzed Results

In the analysis of the operating data, the outdoor temperature data is associated with power consumption data for all the indoor units 42*a* through 42*f* and 52*a* through 52*f* to prepare a correlation chart such as in FIG. 1. Here, the correlation chart is produced by indicating the maximum daily temperatures throughout the period among the outdoor temperature data on the horizontal axis and the power consumption of all the indoor units 42*a* through 42*f* and 52*a* through 52*f* on the day corresponding to the highest temperature on that day on the vertical axis. When, for example, the power consumption on a certain day in the period is 100 kWh in the indoor unit 42*c*, and the highest air temperature on that day is 29° C., this will be plotted as shown by point A in the correlation chart. In this way, the data for all the indoor units 42*a* through 42*f* and 52*a* through 52*f* during the period is plotted in the correlation chart, and an approximate line 1 showing the trend for all the indoor units 42*a* through 42*f* and 52*a* through 52*f* is prepared from the correlation chart. A graph of the displacement in the three indoor units 42*c*, 42*f*, and 52*e* in the order of greatest power consumption displacement is then displayed based on the approximate line 1 showing the trend for all the indoor units 42*a* through 42*f* and 52*a* through 52*f*. Here, three indoor units for which the results of analysis are displayed were selected in order of the greatest power consumption, but the user can specify a different number than 3, such as 1, 2, or 4, as needed.

(3-3) Countermeasure Display

Figure 12:
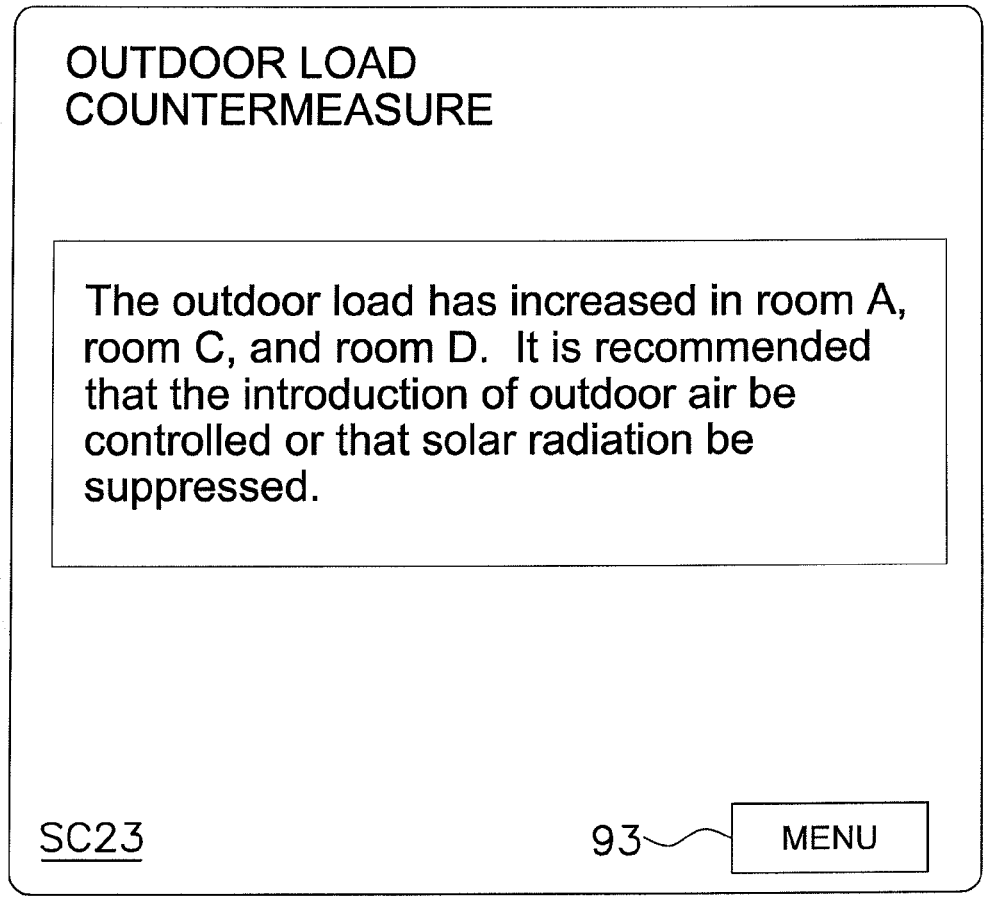
FIG. 12 is an external load countermeasure screen.

The countermeasure display button 83 in the lower right of the outdoor air load determination screen SC13 is pressed to display an external load countermeasure screen SC23 for the indoor units 42*c*, 42*f*, and 52*e* that have been extracted in the results of analysis (see FIG. 12). Here, the external load countermeasure screen SC23 displays the message "The outdoor load has increased in rooms A, C, and D. It is recommended that the introduction of outdoor air be controlled or the solar radiation be suppressed." The user can thus take specific measures to reduce the external load in response to the analyzed results above. The menu button 93 in the lower right of the external load countermeasure screen SC23 is pressed to return to the countermeasure mode selection screen SC1.

(4) Comfort Maintenance Mode

Figure 13:
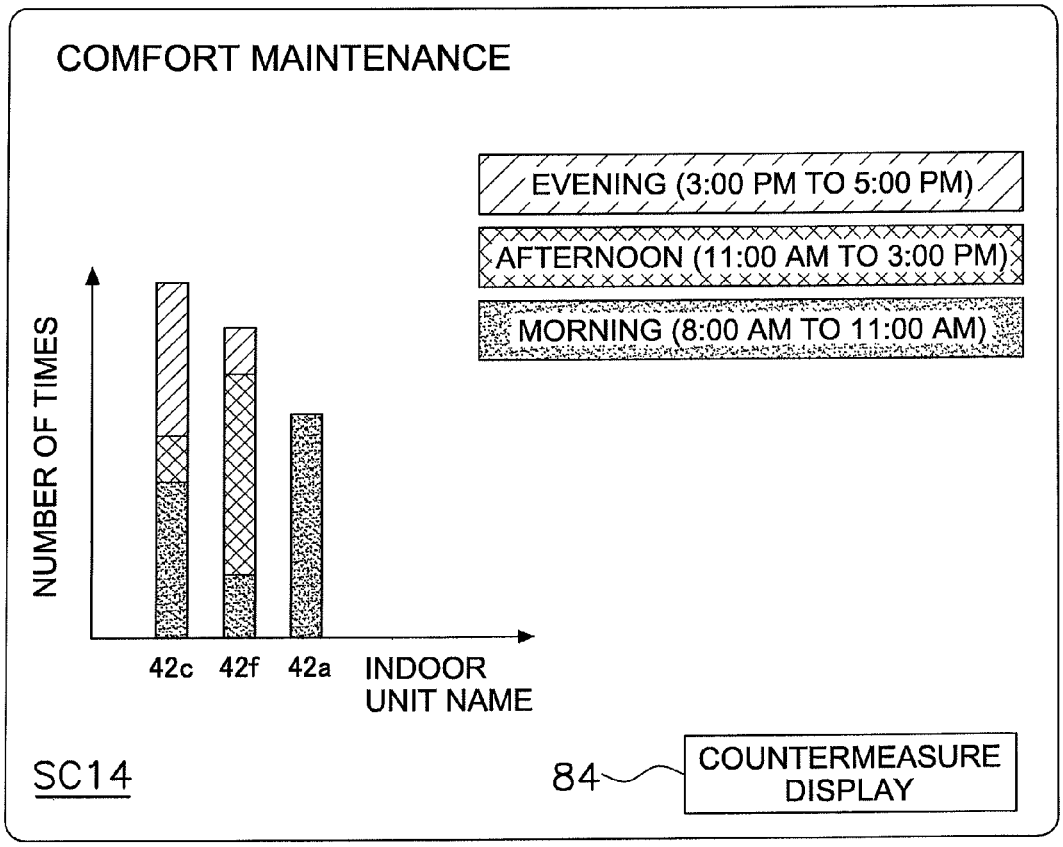
FIG. 13 is a comfort maintenance screen.

In countermeasure mode selection screen SC1, the comfort maintenance button 74 is selected to switch to a comfort maintenance screen SC14. The analyzed change frequency data by time range (see below) is visualized on the comfort maintenance screen SC14 as shown in FIG. 13, and is displayed on the display component 23.

(4-1) Determination of Analysis Target Period

According to the present embodiment, as noted above, the air conditioners 4 and 5 have been operated for a year, and operating data has been previously stored in the memory. The data is analyzed based on the data for the previous year according to the season for which the comfort maintenance button 74 has been selected. The seasons are classified into three patterns: summer (cooling operation period), winter (heating operation period), and an interim period, where summer is the period from June to August, winter spans the three months of December, January, and February, and the interim period is the period from March to May and from September to November.

(4-2) Automatic Analysis and Display of Analyzed Results

In the analysis of the operating data, change frequency data obtained by counting the number of times the air conditioning temperature settings have been changed and changed time range data from when the air conditioning temperature settings were changed are associated to prepare change frequency data by time range. Here, three indoor units 42*c*, 42*f*, and 42*a* are extracted in order of the greatest total number of average change frequency per day and graphed. The expression "greatest number of average change frequency per day" indicates a high possibility that the air conditioning temperature settings of the indoor units 42*c*, 42*f*, and 42*a* have not been set to the optimum temperature. The change frequency can thus be reduced by changing the air conditioning temperature settings to the optimum temperature. Here, the change time range involves dividing the day into the three time ranges of morning, afternoon, and evening. Morning is the time range from 8:00 AM to 11:00 AM, afternoon is the time range from 11:00 AM to 3:00 PM, and evening is the time range from 3:00 PM to 5:00 PM. The air conditioning temperature setting of the indoor unit 42*c* has changed ten times in the morning, three times in the afternoon, and seven times in the evening. The air conditioning temperature setting of the indoor unit 42*f* has changed four times in the morning, 11 times in the afternoon, and three times in the evening. The air conditioning temperature setting of the indoor unit 42*a* has changed 14 times in the morning, and has not changed at all in the afternoon or evening.

(4-3) Countermeasure Display

The countermeasure display button 84 in the lower right of the comfort maintenance screen SC14 is pressed to display a comfort maintenance countermeasure screen SC24 for the indoor units 42*c*, 42*f*, and 42*a* extracted in the results of analysis (see FIG. 14). Here, the comfort maintenance countermeasure screen SC24 shows three patterns: pattern A for a high frequency of change in the morning and evening, pattern B for a high frequency of change in the afternoon, and pattern C for a high frequency of change in only the morning. Five or more changes in each time range are considered frequent. Although five or more changes in each time range is considered frequent here, the number of changes per time range is not limited to five or more and may be set, for example, as four or more or six or more. Pattern A is determined for the indoor unit 42*c*, and a message is displayed: "The change in temperature during the morning and evening is considered significant in Room A. It is recommended that the level of outside air introduced into room A be reduced." Pattern B is determined for the indoor unit 42*f*, and a message is displayed: "The outdoor load on Room C has increased. It is recommended that the level of outside air introduced into room C be limited or that solar radiation be controlled." Pattern C is determined for the indoor unit 42*a*, and a message is displayed: "The air conditioning is working too much at startup in Room A. It is recommended that the air level at startup be controlled." The display of these countermeasures allows the user to take specific measures to maintain comfort in response to the results of analysis above. The menu button 94 in the lower right of the comfort maintenance countermeasure screen SC24 is pressed to return to the countermeasure mode selection screen SC1.

(5) Outdoor Air Introduction Determination Mode

Figure 15:
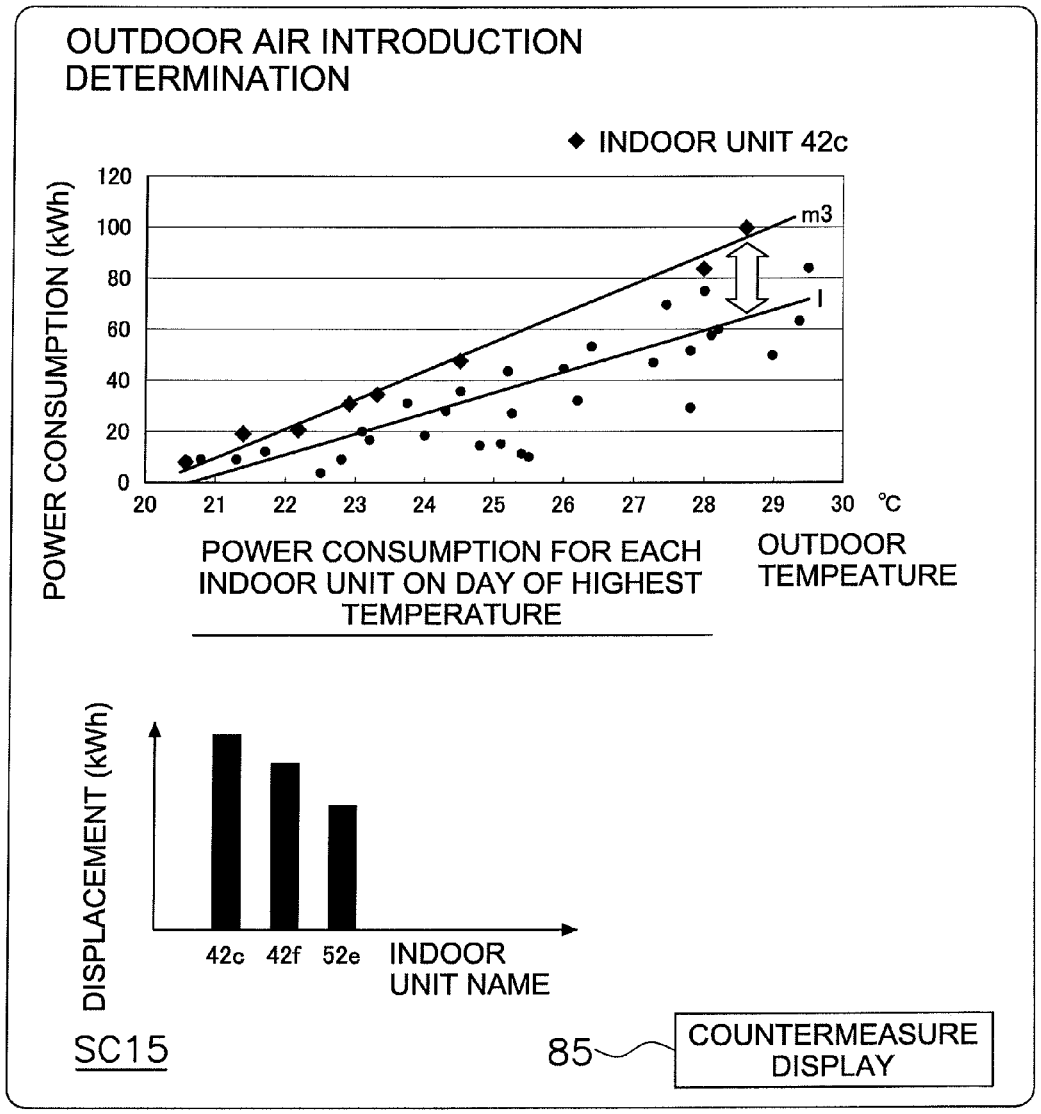
FIG. 15 is an outdoor air introduction determination screen.

In the countermeasure mode selection screen SC1, the outdoor air introduction determination button 75 is selected to switch to an outdoor air introduction determination screen SC15. The analyzed data on power consumption by outdoor temperature is visualized on the outdoor air introduction determination screen SC15 as shown in FIG. 15 and is displayed on the display component 23.

(5-1) Determination of Analysis Target Period

According to the present embodiment, as noted above, the air conditioners 4 and 5 have been operated for a year, and operating data has been previously stored in the memory 22. The data is analyzed based on the data for the previous year according to the season for which the outdoor air introduction determination button 75 has been selected. The seasons are classified into three patterns: summer (cooling operation period), winter (heating operation period), and an interim period, where summer is the period from June to August, winter spans the three months of December, January, and February, and the interim period is the period from March to May (first interim period) and from September to November (second interim period). The outdoor air introduction determination mode is a mode limited to the interim periods.

When, for example, the outdoor air introduction determination button is selected on Apr. 25, 2006, since the season is the first interim period, the operating data collected from Mar. 1, 2005 to May 31, 2005 among the previous year of operating data is analyzed.

(5-2) Automatic Analysis and Display of Analyzed Results

In the analysis of the operating data, the outdoor temperature data and the power consumption data for all of the indoor units 42*a* through 42*f* and 52*a* through 52*f* are associated to prepare a correlation chart such as in FIG. 15. Here, the correlation chart is produced by indicating the maximum daily temperatures throughout the period among the outdoor temperature data on the horizontal axis and the power consumption of all the indoor units 42*a* through 42*f* and 52*a* through 52*f* on the day corresponding to the highest temperature on that day on the vertical axis. When, for example, the power consumption on a certain day in the period is 100 kWh in the indoor unit A, and the highest air temperature on that day is 29° C., this will be plotted as shown by point A in the correlation chart. In this way, the data for all the indoor units 42*a* through 42*f* and 52*a* through 52*f* during the period is plotted in the correlation chart, and an approximate line 1 showing the trend for all the indoor units 42*a* through 42*f* and 52*a* through 52*f* is prepared from the correlation chart. Approximate lines m1 through m12 showing the trends for all the indoor units 42*a* through 42*f* and 52*a* through 52*f* are also prepared in the correlation chart (only m3 is shown). Here, the approximate lines m1 through m12 are prepared for the number of indoor units 42*a* through 42*f* and 52*a* through 52*f*, resulting in the preparation of the 12 approximate lines m1 through m12 according to the present embodiment. For example, the approximate line m3 for the indoor unit 42*c* is prepared from the correlation chart in which the power consumption data for the indoor unit 42*c* has been plotted. A graph of the displacement in the three indoor units 42*c*, 42*f*, and 52*e* in the order of greatest displacement is then displayed based on the approximate line 1 in which the approximate lines m1 through m12 show the trend for all the indoor units 42*a* through 42*f* and 52*a* through 52*f*. Here, three indoor units for which the results of analysis are displayed were selected in order of the greatest power consumption, but the user can specify a different number than 3, such as 1, 2, or 4, as needed.

(5-3) Countermeasure Display

The countermeasure display button 85 in the lower right of the outdoor air introduction determination screen SC15 is pressed to display an outdoor air introduction countermeasure screen SC25 for the indoor units 42*c*, 42*f*, and 52*e* that have been extracted in the results of analysis (see FIG. 16). Here, a message is displayed by the countermeasure display: "The internal load on room A, room, C, and room D may have increased. It is recommended that the outdoor intake level for the rooms be increased." The user can thus take specific measures to reduce the power consumption in response to the analyzed results above. The menu button 95 in the low right of the outdoor air introduction countermeasure screen SC25 is pressed to return to the countermeasure mode selection screen SC1.

(6) Simultaneous Cooling/Heating Operation Energy Conservation Mode

Figure 17:
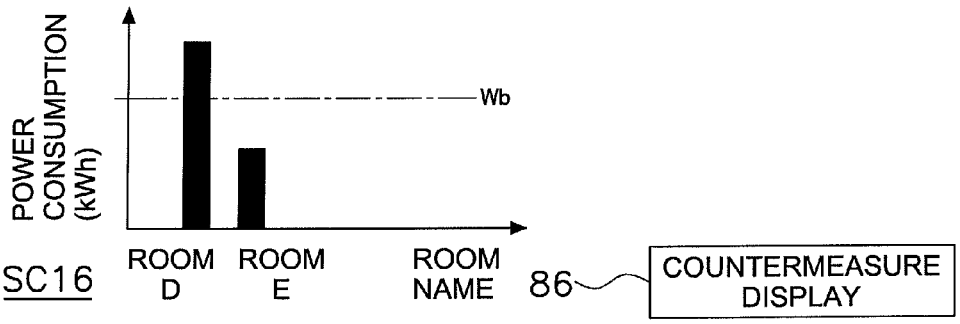
FIG. 17 is a simultaneous cooling/heating operation optimization screen.

In the countermeasure mode selection screen SC1, the simultaneous cooling/heating operation optimization button 76 is selected to switch to a simultaneous cooling/heating optimization screen SC16. The analyzed cooling/heating operation mode data is visualized on the simultaneous cooling/heating optimization screen SC16 as shown in FIG. 17 and is displayed on the display component 23.

(6-1) Determination of Analysis Target Period

According to the present embodiment, as noted above, the second air conditioner 5 has been operated for a year, and operating data has been previously stored in the memory 22. The data is analyzed based on the data for the previous year according to the season for which the simultaneous cooling/heating operation optimization button has been selected. The seasons are classified into three patterns: summer (cooling operation period), winter (heating operation period), and an interim period, where summer is the period from June to August, winter spans the three months of December, January, and February, and the interim period is the period from March to May (first interim period) and from September to November (second interim period). The simultaneous cooling/heating operation energy conservation mode is a mode limited to the interim periods.

When, for example, the simultaneous cooling/heating operation optimization button 76 is selected on Apr. 25, 2006, since the season is the first interim period, the operating data collected from Mar. 1, 2005 to May 31, 2005 among the previous year of operating data is analyzed.

(6-2) Automatic Analysis and Display of Analyzed Results

In the analysis of the operating data, the simultaneous cooling/heating operation data and the power consumption data for all of the indoor units 52*a* through 52*f* of the second air conditioner 5 in the room D RM21 and all of the indoor units 52*a* through 52*f* of the second air conditioner 5 in the room E RM31 are associated to prepare a table such as in FIG. 17. In the table in FIG. 17, the group G4 and group G6 in room D RM21 are in cooling operation, and the group G5 adjacent to the groups G4 and G6 is in heating operation. In the room E, all of the groups G4 through G6 are in cooling operation. The air conditioning temperature settings of the second air conditioner 5 in the room D RM21 and the room E RM31 is 24° C. This is displayed in the graph in the lower part of the table in the order of greatest power consumption.

(6-3) Countermeasure Display

The countermeasure display button 86 in the lower right of the simultaneous cooling/heating operation optimization screen SC16 is pressed to display a simultaneous cooling/heating operation optimization countermeasure screen SC26 for the second air conditioner 5 in the room D RM21 which has been extracted in the results of analysis and is over the standard power consumption Wb (see FIG. 18). Here, the simultaneous cooling/heating operation optimization countermeasure screen SC26 displays the message: "Cooling and heating are operating simultaneously in room D. It is recommended that the temperature setting in room D be lowered to make the operation mode consistent with either cooling or heating." The user can thus take specific measures to reduce power consumption in response to the analyzed results above. The display returns to the countermeasure mode selection screen SC1 when the menu button 96 in the lower right of the simultaneous cooling/heating operation optimization countermeasure screen SC26 is pressed.

(7) Mode for Optimizing Number of Operating Units

In the countermeasure mode selection screen SC1, the button 77 for optimizing the number of operating units is selected to switch to a screen SC17 for optimizing the number of operating units. The analyzed data on times when the thermostat is off by outdoor temperature is visualized on the screen SC17 for optimizing the number of operating units as shown in FIG. 19 and is displayed on the display component 23.

(7-1) Determination of Analysis Target Period

According to the present embodiment, as noted above, the air conditioners 4 and 5 have been operated for a year, and operating data has been previously stored in the memory 22. The data is analyzed based on the data for the previous year according to the season for which the button 77 for optimizing the number of operating units has been selected. The seasons are classified into three patterns: summer (cooling operation period), winter (heating operation period), and an interim period, where summer is the period from June to August, winter spans the three months of December, January, and February, and the interim period is the period from March to May (first interim period) and from September to November (second interim period). The mode for optimizing the number of operating units is a mode limited to the interim periods.

When, for example, the button for optimizing the number of operating units is selected on Apr. 25, 2006, since the season is the first interim period, the operating data collected from Mar. 1, 2005 to May 31, 2005 among the previous year of operating data is analyzed.

(7-2) Automatic Analysis and Display of Analyzed Results

In the analysis of the operating data, the outdoor temperature data and the data on times when the thermostat is off for the indoor units 42*a* through 42*f* and 52*a* through 52*f* are associated to prepare a table such as in FIG. 19. In this table, the number of indoor units for which the thermostat is off all day is summarized by outdoor temperature for each room. This is displayed in the order of rooms with the greatest number of stopped units. When, for example, the outdoor temperature is 19° C. as shown in FIG. 19, the thermostat is off in two of the indoor units 42*a* through 42*c* (indoor units 42*a* and 42*b*) in room A RM11, and the thermostat is off in one of the indoor units 42*d* and 42*e* in room B RM12. Although not shown in FIG. 19, the thermostat is off in none of the units in room C RM13, room D RM21, or room E RM31.

(7-3) Countermeasure Control

When the countermeasure button 87 in the lower right of the screen SC17 for optimizing the number of operating units is pressed, the number of operating units is optimized for the indoor units 42*a* through 42*c* in room A RM11 extracted in the results of analysis, and the number of units is controlled by the control component 27 so that only one indoor unit (such as indoor unit 42*a*) is operated in room A RM11. The number of units in room B RM12 is controlled by the control component 27 in the same manner as room A RM11 so that only one indoor unit (such as indoor unit 42*d*) is operated.

Features (1)

In the present invention, the operating data of the air conditioners 4 and 5, such as power consumption data, air conditioning temperature setting data, power demand data, outside temperature data, change frequency data, changed time range data, and data on times when the thermostat is off, is collected in the memory 22 through the communications component 24. The collected operating data is analyzed by seven power consumption countermeasure modes, and the analyzed data is visualized and displayed on the display component 23. Power consumption countermeasures which have been predetermined on the basis of the analyzed data are also displayed on the display component. The user can thus ascertain the operating status and can take specific measures to reduce the power consumption.

(2)

In the present invention, power consumption data and air conditioning temperature setting data retrieved via the communications component 24 are associated and collected in the memory 22 as temperature setting-power consumption data for the indoor units 42*a* through 42*f* and 52*a* through 52*f*. Based on the temperature setting-power consumption data stored in the memory 22, the data processor 21 extracts three indoor units 42*c*, 42*f*, and 52*e* in the order of greatest power consumption from among the indoor units in which the air conditioning temperature setting is below 28° C. when in cooling operation. The temperature setting-power consumption data for the three indoor units 42*c*, 42*f*, and 52*e* extracted by the data processor 21 is also graphed and displayed on the display component 23. The user is also advised to increase the target temperature settings in the indoor units 42*c*, 42*f*, and 52*e* extracted by the data processor 21.

The data processor 21 can thus extract the three indoor units 42*c*, 42*f*, and 52*e* in which the target temperature setting is a temperature that is so low that such a temperature cannot be recommended, and which are highly likely to be wasting energy. The power consumption and the target temperature settings of the extracted indoor units can be graphed to notify the user. The user can therefore be notified of the indoor units which are highly likely to be wasting energy, along with the operating data, leading to countermeasures for reducing power consumption. The user can also be presented with countermeasures for reducing power consumption, and not merely shown the operating data of the indoor units 42*c*, 42*f*, and 52*e* which are highly likely to be wasting energy. This can therefore lead to effective countermeasures for reducing power consumption, and can also alleviate the burden on the user.

(3)

In the present invention, power demand data retrieved via the communications component 24 is collected in the memory 22 for each indoor unit 42*a* through 42*f* and 52*a* through 52*f*. Based on the power demand data stored in the memory 22, the data processor 21 calculates the peak production time in which the overall power demand has peaked in the air conditioners 4 and 5, and extracts the three indoor units 42*c*, 52*e*, and 52*f* in the order of greatest power demand in the peak production time. The power demand data during the peak production time for the three indoor units 42*c*, 52*e*, and 52*f* extracted by the data processor 21 can also be graphed and displayed on the display component 23. The user is also advised to suppress and control the power demand in the indoor units 42*c*, 52*e*, and 52*f* extracted by the data processor 21.

The data processor 21 can thus extract the three indoor units 42*c*, 52*e*, and 52*f* which have substantial indoor unit power demand in the peak production time and which are highly likely to be have a significant effect on the overall power demand. The power demand data of the extracted indoor units 42*c*, 52*e*, and 52*f* can also be graphed to notify the user. The user can therefore be notified of the indoor units 42*c*, 52*e*, and 52*f* which are highly likely to have a significant effect on the overall power demand, along with the operating data, leading to countermeasures for reducing power consumption. The user can also be presented with countermeasures for reducing power consumption, and not merely shown the operating data of the indoor units 42*c*, 52*e*, and 52*f* which are highly likely to have a significant effect on the overall power demand. This can therefore lead to effective countermeasures for reducing power consumption, and can also alleviate the burden on the user.

(4)

In the present invention, power consumption data and outdoor temperature data retrieved via the communications component 24 are associated and collected in the memory 22 as data on power consumption by outdoor temperature for the indoor units 42*a* through 42*f* and 52*a* through 52*f*. Based on the power consumption data by outdoor temperature stored in the memory 22, the data processor 21 extracts three indoor units in order of the greatest displacement in trends for each of the indoor units 42*a* through 42*f* and 52*a* through 52*f* based on the trends for all of the indoor units 42*a* through 42*f* and 52*a* through 52*f*. The displacement revealed by comparison between, first, the operating data for the three indoor units 42*c*, 42*f*, and 52*e* extracted by the data processor 21 and, second, the approximate line 1 showing the trends for all the indoor units is also graphed and displayed on the display component. The user is advised, for example, to lower blinds to block externally radiated heat or to lower the level of introduced outdoor air having a substantial load, so as to suppress the external load in room A RM11, room C RM13, and room D RM21 in which the indoor units 42*c*, 42*f*, and 52*e* extracted by the data processor 21 are set up.

The data processor 21 can thus extract the three indoor units 42*c*, 42*f*, and 52*e* which are highly likely to be air conditioning rooms subject to substantial external load (room A RM11, room C RM13, and room D RM21). The displacement revealed by comparison between, first, the operating data for the extracted indoor units 42*c*, 42*f*, and 52*e* and, second, the approximate line 1 can also be graphed to notify the user. The user can therefore be notified of rooms which are highly likely to be subject to substantial external load (room A RM11, room C RM13, and room D RM21), which can lead to countermeasures for reducing power consumption. The user can also be presented with countermeasures for reducing power consumption, and not merely shown the operating data of the indoor units 42*c*, 42*f*, and 52*e*, which are highly likely to be air conditioning rooms that are subject to considerable external load. This can therefore lead to effective countermeasures for reducing power consumption, and can also alleviate the burden on the user.

(5)

In the present invention, power consumption data and outdoor temperature data retrieved via the communications component 24 are associated and collected in the memory 22 as power consumption data by outdoor temperature for the indoor units 42*a* through 42*f* and 52*a* through 52*f*. Based on the power consumption data by outdoor temperature collected in the memory 22, the data processor 21 extracts three indoor units 42*c*, 42*f*, and 52*e* in order of the greatest displacement in trends for each of the indoor units 42*a* through 42*f* and 52*a* through 52*f* based on the trends for all of the indoor units 42*a* through 42*f* and 52*a* through 52*f*. The displacement revealed by comparison between, first, the approximate lines m1 through m12 representing the trends of each the three indoor units 42*c*, 42*f*, and 52*e* extracted by the data processor 21 and, second, the approximate line 1 showing the trends for all the indoor units is also graphed and displayed on the display component. The user is advised, for example, to increase the outdoor intake level for room A RM11, room C RM13, and room D RM21 in which the indoor units 42*c*, 42*f*, and 52*e* extracted by the data processor 21 are set up.

The data processor 21 can thus extract the three indoor units 42*c*, 42*f*, and 52*e*, which are highly likely to be air conditioning rooms subject to substantial internal load (room A RM11, room C RM13, and room D RM21). The displacement revealed by comparison between, first, the approximate lines mx representing the trends of each the three extracted indoor units 42*c*, 42*f*, and 52*e* and, second, the approximate line 1 can also be graphed to notify the user. The user can therefore be notified of rooms which are highly likely to be subject to substantial internal load (room A RM11, room C RM13, and room D RM21), which can lead to countermeasures for reducing power consumption. The user can also be presented with countermeasures for reducing power consumption, and not merely shown the operating data of the indoor units 42*c*, 42*f*, and 52*e* which are highly likely to be air conditioning rooms that are subject to considerable internal load. This can therefore lead to effective countermeasures for reducing power consumption, and can also alleviate the burden on the user.

(6)

In the present invention, change data and changed time range data retrieved via the communications component 24 are associated and collected in the memory 22 as change frequency data by time range for the indoor units 42*a* through 42*f* and 52*a* through 52*f*. Based on the change frequency data by time range collected in the memory 22, the data processor 21 extracts three indoor units 42*c*, 42*f*, and 42*a* in the order of most frequent overall changes in each of the indoor units 42*a* through 42*f* and 52*a* through 52*f*. The change frequency data by time range for the three indoor units 42*c*, 42*f*, and 42*a* extracted by the data processor 21 is also graphed and displayed on the display component 23. The user is also advised to, for example, lower blinds to block externally radiated heat or to lower the level of introduced outdoor air having a substantial load, so as to suppress the external load on the indoor units 42*c*, 42*f*, and 42*a* extracted by the data processor 21.

The data processor 21 can thus extract the three indoor units 42*c*, 42*f*, and 42*a* in which the sensory temperature and target temperature settings are highly likely to be not matched. The change frequency data by time range for the extracted indoor units 42*c*, 42*f*, and 42*a* can be graphed to notify the user. The user can therefore be notified of the indoor units in which the sensory temperature and target temperature settings are highly likely to be not matched, along with the operating data, leading to countermeasures for reducing power consumption. The user can also be presented with countermeasures for reducing power consumption. This can therefore lead to effective countermeasures for reducing power consumption, and can also alleviate the burden on the user.

(7)

In the present invention, data on times when the thermostat is off, and outdoor temperature data retrieved via the communications component 24, are associated and stored in the memory 22 as data on times when the thermostat is off by outdoor temperature for each of the indoor units 42*a* through 42*f* and 52*a* through 52*f*. Based on the data on times when the thermostat is off by outdoor temperature stored in the memory 22, the data processor 21 displays the results in the order of rooms with the greatest number of units for which the thermostat is off by outdoor temperature. The number of indoor units is also automatically controlled by the control component 27 according to the outdoor temperature.

The data processor 21 can thus extract the indoor units of rooms in which the thermostat is off for a long time and in which only air is highly likely to be blowing wastefully. The number of operating indoor units 42*a* through 42*c* in the extracted room (room A RM11) can be controlled and indoor units which are highly likely to be only blowing air wastefully can be stopped. This can therefore lead to effective countermeasures for reducing power consumption, and can also alleviate the burden on the user.

Modifications

Embodiments of the present invention were described on the basis of drawings, but the specific structure is not limited to these embodiments and can be modified within scope that does not depart from the spirit of the invention.

(1)

In the present embodiment, the air conditioners 4 and 5 were provided in a three-story building, but buildings in which the air conditioners 4 and 5 may be provided are not limited to three stories. The air conditioner monitor/support system 1 is also not limited to three air conditioning systems that can be monitored, but may be used for four systems, five systems, or the like.

(2) In the wasteful operation elimination mode according to the present embodiment, the selected objects were the indoor units 42*a* through 42*f* and 52*a* through 52*f* of considerable power consumption, in which the air conditioning temperature setting was below 28° C. during cooling operation, but the air conditioning temperature setting is not limited to a temperature below 28° C., and may, for example, be a temperature below 27° C. or below 29° C.

(3)

In the mode for optimizing the number of operating units according to the present embodiment, the countermeasure button 87 in the lower right of the screen SC17 for optimizing the number of operating units is pressed to optimize the number of operating indoor units of rooms that have been extracted in the results of analysis, but the invention is not limited to this option alone, and the countermeasure button 87 in the lower right of the screen SC17 for optimizing the number of operating units may be pressed to display a countermeasure screen SC27 for optimizing the number of operating units (see FIG. 20).

Here, the countermeasure screen SC27 for optimizing the number of operating units displays a message: "The number of thermostats that are off in room A has increased. It is recommended that the operation of the indoor units in room A be stopped." This will allow the user to take specific measures to reduce power consumption in response to the above results of analysis. The menu button 97 in the lower right of the countermeasure screen SC27 for optimizing the number of operating units is pressed to return to the countermeasure mode selection screen SC1.

INDUSTRIAL APPLICABILITY

The air conditioning control device in the present invention allows the user to ascertain the operating status and readily implement countermeasures to reduce power consumption, and is useful as an air conditioning control device or the like for retrieving and monitoring operating data related to air conditioners.

What is claimed is:

1. An air conditioning control device for obtaining and controlling data on an air conditioner including a plurality of indoor units, the air conditioning control device comprising:

a data retrieval component configured to retrieve operating data on the air conditioner, the operating data including power consumption data for each of the indoor units;

a data collection component configured to collect the operating data at prescribed periods;

an analysis component configured to analyze the operating data of each indoor unit;

an analyzed results display component configured to display the analyzed data;

a power consumption countermeasure table configured to associate the analyzed data with countermeasures to reduce power consumption; and an extraction component configured to extract the countermeasures to reduce power consumption from the power consumption countermeasure table based on the analyzed data in order to reduce power consumption of the air conditioner, the analyzed results display component being further configured to display the countermeasures to reduce power consumption, the operating data including change frequency data and changed time range data, the change frequency data including a counted number of times target air conditioning temperature settings have been changed when indoor units are air conditioning an indoor area, and the changed time range data including actual changes in the air condition temperature settings the data collection component being further configured to associate the change frequency data and the changed time range data to obtain change frequency data by time range for each indoor unit, the analysis component being further configured to select a certain number of indoor units with a larger change frequency than a remainder of the indoor units based on the change frequency data by time range, and the analyzed results display component being further configured to display the change frequency data by time range for the indoor units that have been selected by the analysis component.

2. The air conditioning control device according to claim 1, wherein the extraction component is further configured to extract countermeasures to reduce power consumption that recommend suppressing an external load on an indoor area being air conditioned by the indoor units selected by the analysis component; and the analyzed results display component is further configured to display the countermeasures to reduce power consumption.

3. An air conditioning control device for obtaining and controlling data on an air conditioner including a plurality of indoor units, the air conditioning control device comprising:

a data retrieval component configured to retrieve operating data on the air conditioner, the operating data including power consumption data for each of the indoor units;

a data collection component configured to collect the operating data at prescribed periods;

an analysis component configured to analyze the operating data of each indoor unit;

an analyzed results display component configured to display the analyzed data;

a power consumption countermeasure table configured to associate the analyzed data with countermeasures to reduce power consumption; and an extraction component configured to extract the countermeasures to reduce power consumption from the power consumption countermeasure table based on the analyzed data in order to reduce power consumption of the air conditioner, the analyzed results display component being further configured to display the countermeasures to reduce power consumption, the operating data including air conditioning temperature setting data for each of the indoor units, the air conditioning temperature setting data corresponding to target temperature settings of the indoor units when the indoor units are air conditioning indoor areas, the data collection component being further configured to associate the air conditioning temperature setting data with the power consumption data to obtain temperature setting/power consumption data for each indoor unit, the analysis component being further configured to use the temperature setting/power consumption data to select a certain number of indoor units with more power consumption than a remainder of the indoor units, the certain number of indoor units being selected from among indoor units in which the target temperature setting is lower than a first predetermined temperature setting when in cooling operation and indoor units in which the target temperature setting is over a second predetermined temperature setting when in heating operation, and the analysis display component being further configured to display the temperature setting/power consumption data of the indoor units selected by the analysis component.

4. The air conditioning control device according to claim 3, wherein the extraction component is further configured to extract countermeasures to reduce power consumption that recommend increasing the target temperature settings of the indoor units selected by the analysis component when in cooling operation and countermeasures to reduce power consumption that recommend lowering the target temperature settings when in heating operation; and the analyzed results display component is further configured to display the countermeasures to reduce power consumption.

5. An air conditioning control device for obtaining and controlling data on an air conditioner including a plurality of indoor units, the air conditioning control device comprising:

a data retrieval component configured to retrieve operating data on the air conditioner, the operating data including power consumption data for each of the indoor units;

a data collection component configured to collect the operating data at prescribed periods;

an analysis component configured to analyze the operating data of each indoor unit;

an analyzed results display component configured to display the analyzed data;

a power consumption countermeasure table configured to associate the analyzed data with countermeasures to reduce power consumption; and an extraction component configured to extract the countermeasures to reduce power consumption from the power consumption countermeasure table based on the analyzed data in order to reduce power consumption of the air conditioner, the analyzed results display component being further configured to display the countermeasures to reduce power consumption, the operating data including power demand data for each of the indoor units, the power demand data corresponding to the power consumption data of the indoor units by time range, the data collection component being further configured to collect the power demand data to obtain indoor unit power demand data for each indoor unit, the analysis component being further configured to analyze the power demand data to calculate peak production time and being further configured to select a certain number of indoor units with more power demand per indoor unit in the peak production time than a remainder of the indoor units, overall peak power demand for the air conditioner being produced during the peak production time, and the analyzed results display component being further configured to display the indoor unit power demand data in peak production time of the indoor units selected by the analysis component.

6. The air conditioning control device according to claim 5, wherein the extraction component is further configured to extract countermeasures to reduce power consumption that recommend suppressing and controlling power demand of the indoor units selected by the analysis component; and the analyzed results display component is further configured to display the countermeasures to reduce power consumption.

7. An air conditioning control device for obtaining and controlling data on an air conditioner including a plurality of indoor units, the air conditioning control device comprising:

a data retrieval component configured to retrieve operating data on the air conditioner, the operating data including power consumption data for each of the indoor units;

a data collection component configured to collect the operating data at prescribed periods;

an analysis component configured to analyze the operating data of each indoor unit;

an analyzed results display component configured to display the analyzed data;

a power consumption countermeasure table configured to associate the analyzed data with countermeasures to reduce power consumption; and an extraction component configured to extract the countermeasures to reduce power consumption from the power consumption countermeasure table based on the analyzed data in order to reduce power consumption of the air conditioner, the analyzed results display component being further configured to display the countermeasures to reduce power consumption, the operating data including outdoor temperature data, the data collection component being configured to associate the outdoor temperature data and the power consumption data to obtain power consumption data relative to outdoor temperature for each indoor unit, the analysis component being further configured to analyze an overall indoor unit trend of all of the indoor units as a whole and to analyze individual indoor unit trends of the individual indoor units based on the power consumption data relative to outdoor temperature, and being further configured to select a certain number of indoor units with more trend displacement of individual indoor unit trend dative to the overall indoor unit trend than a remainder of the indoor units, and the analyzed results display component being further configured to display compared data from comparison of the individual indoor unit trends to the overall indoor unit trend of the indoor units selected by the analysis component.

8. The air conditioning control device according to claim 7, wherein the extraction component is configured to extract countermeasures to reduce power consumption that recommend suppressing external load on an indoor area being air conditioned by the indoor units selected by the analysis component when there is a significant air conditioning load due to the outdoor temperature; and the analyzed results display component is further configured to display the countermeasures to reduce power consumption.

9. The air conditioning control device according to claim 7, wherein the extraction component is further configured to extract countermeasures to reduce power consumption that recommend increasing a level of outdoor air introduced into an indoor area being air conditioned by the indoor units selected by the analysis component when there is a low air conditioning load due to the outdoor temperature; and the analyzed results display component is further configured to display the countermeasures to reduce power consumption.

10. An air conditioning control device for obtaining and controlling data on an air conditioner including a plurality of indoor units, the air conditioning control device comprising:

a data retrieval component configured to retrieve operating data on the air conditioner, the operating data including power consumption data for each of the indoor units;

a data collection component configured to collect the operating data at prescribed periods;

an analysis component configured to analyze the operating data of each indoor unit;

an analyzed results display component configured to display the analyzed data;

a power consumption countermeasure table configured to associate the analyzed data with countermeasures to reduce power consumption; and an extraction component configured to extract the countermeasures to reduce power consumption from the power consumption countermeasure table based on the analyzed data in order to reduce power consumption of the air conditioner, the analyzed results display component being further configured to display the countermeasures to reduce power consumption, the operating data including outdoor temperature data and data on times when a thermostat is off for each indoor unit, the data collection component being further configured to associate the outdoor temperature data and the data on times when the thermostat is off to obtain data on times when the thermostat is off relative to outdoor temperature for each indoor unit, the analysis component being further configured to select a certain number of indoor units with a longer time for which the thermostat is off relative to outdoor temperature than a remainder of the indoor units, and the analyzed results display component being further configured to display the data on times when the thermostat is off relative to outdoor temperature for the indoor units that have been selected by the analysis component.

11. The air conditioning control device according to claim 10, wherein the extraction component is further configured to extract countermeasures to reduce power consumption that recommend stopping operation of the indoor units selected by the analysis component, and the analyzed results display component is further configured to display the countermeasures to reduce power consumption.

12. The air conditioning control device according to claim 11, further comprising a control component configured to stop the indoor units selected by the analysis component based on the data on times when the thermostat is off.

13. The air conditioning control device according to claim 10, further comprising a control component configured to stop the indoor units selected by the analysis component based on the data on times when the thermostat is off.

* * * * *

UNITED STATES PATENT AND TRADEMARK OFFICE

CERTIFICATE OF CORRECTION

PATENT NO. : 7,542,824 B2
APPLICATION NO. : 12/279941
DATED : June 2, 2009
INVENTOR(S) : Toshiyuki Miki et al.

It is certified that error appears in the above-identified patent and that said Letters Patent is hereby corrected as shown below:

Column 28,
Line 19, "trend dative to the overall indoor unit trend" should read -- trend relative to the overall indoor unit trend --.

Signed and Sealed this

Thirteenth Day of October, 2009

David J. Kappos

David J. Kappos
*Director of the United States Patent and Trademark Office*